US010135136B2

(12) United States Patent
Hasegawa et al.

(10) Patent No.: US 10,135,136 B2
(45) Date of Patent: Nov. 20, 2018

(54) TIME DELAY DEVICE AND PHASED ARRAY ANTENNA

(71) Applicant: FUJIKURA LTD., Tokyo (JP)

(72) Inventors: Yuta Hasegawa, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 33 days.

(21) Appl. No.: 15/445,007

(22) Filed: Feb. 28, 2017

(65) Prior Publication Data

US 2017/0279195 A1 Sep. 28, 2017

(30) Foreign Application Priority Data

Mar. 24, 2016 (JP) ..... 2016-060440

(51) Int. Cl.
*H01Q 3/26* (2006.01)
*H01Q 21/22* (2006.01)

(52) U.S. Cl.
CPC ..... *H01Q 3/2682* (2013.01); *H01Q 21/22* (2013.01)

(58) Field of Classification Search
CPC ..... H01Q 3/2682; H01Q 21/22
See application file for complete search history.

(56) References Cited

U.S. PATENT DOCUMENTS

2012/0319746 A1* 12/2012 Hayashi ..... H01Q 3/42 327/141
2014/0192923 A1* 7/2014 Matsuo ..... H01Q 3/2605 375/296

FOREIGN PATENT DOCUMENTS

| | | | |
|---|---|---|---|
| JP | 2003-60424 | A | 2/2003 |
| JP | 2013-34129 | A | 2/2013 |
| JP | 2017-175432 | A | 9/2017 |
| WO | 2011/108397 | A1 | 9/2011 |
| WO | 2017/077787 | A1 | 5/2014 |

OTHER PUBLICATIONS

Schwartz et al., "An Electronic UWB Continuously Tunable Time-Delay System With Nanosecond Delays", IEEE Microwave and Wireless Components Letters, vol. 18, No. 2, pp. 103-105, Feb. 2008.

Office Action dated Nov. 7, 2017, issued in counterpart Japanese Application No. 2016-060440, with English translation. (5 pages).

Decision to Grant a Patent dated Mar. 20, 2018, issued in counterpart Japanese Application No. 2016-060440, with English translation. (4 pages).

* cited by examiner

*Primary Examiner* — Dameon E Levi
*Assistant Examiner* — David Lotter
(74) *Attorney, Agent, or Firm* — Westerman, Hattori, Daniels & Adrian, LLP

(57) ABSTRACT

The present invention provides a time delay device which allows changing, in accordance with a frequency of a local signal, a delay in a radio frequency signal supplied to an antenna element and also allows reducing a degree of dependency of the delay on a radio frequency in a band which is used. Each of (i) dispersion caused by a first dispersion imparting filter which gives a delay to a first local signal and (ii) dispersion caused by a second dispersion imparting filter which gives a delay to an intermediate frequency signal generated from the first local signal and the radio frequency signal is set to have a positive or negative sign which is opposite to the sign of the other.

6 Claims, 13 Drawing Sheets

TIME DELAY DEVICE AND PHASED ARRAY ANTENNA

This Nonprovisional application claims priority under 35 U.S.C. § 119 on Patent Application No. 2016-060440 filed in Japan on Mar. 24, 2016, the entire contents of which are hereby incorporated by reference.

TECHNICAL FIELD

The present invention relates to a time delay device which imparts a time delay to a radio frequency signal. The present invention also relates to a phased array antenna including the time delay device.

BACKGROUND ART

In an attempt to increase capacity of wireless communications, frequency bands used are increasingly in a broader frequency range as well as in a higher frequency region. In recent years, not only a microwave band (not less than 0.3 GHz and not more than 30 GHz) but also a millimeter wave band (not less than 30 GHz and not more than 300 GHz) is used in wireless communications. In particular, 60 GHz band, in which a great attenuation occurs in the atmosphere, is attracting attention as a band in which data leakage is less likely to occur and a large number of communication cells with reduced size can be arranged.

An antenna which is used in a wireless communication in 60 GHz band is expected to have a high gain as well as operate in a wide frequency band. This is because a great attenuation occurs in 60 GHz band in the atmosphere, as described above. Examples of an antenna which has a gain high enough to allow the antenna to be used in 60 GHz band include an array antenna. Note here that the array antenna refers to an antenna in which a plurality of antenna elements are arranged in an array or in matrix.

In the array antenna, a main beam direction of a radiated electromagnetic wave, which is obtained by superimposing electromagnetic waves radiated from the respective plurality of antenna elements, can be changed by control of a time delay imparted to a radio frequency signal supplied to each of the plurality of antenna elements. The array antenna having such a beam forming function is called a phased array antenna, and has been a subject of vigorous research and development.

A principle of beam forming performed in the phased array antenna is discussed below with reference to FIG. 12. The following description is based on the assumption that a plurality of antenna elements A1 through An constituting a phased array antenna are arranged on a specific straight line at regular intervals d.

In a case where radio frequency signals having an identical phase are supplied to the respective antenna elements A1 through An, an equiphase plane parallel to the specific straight line is formed, and a main beam direction is perpendicular to the equiphase plane. In this case, when time delays δ1 through δn with an equal difference therebetween are imparted to the respective radio frequency signals supplied to the antenna elements A1 through An, the equiphase plane is tilted in accordance with a time delay difference $\Delta t=\delta 2-\delta 1=\delta 3-\delta 2= \ldots =\delta n-\delta n-1$. Here, the time delay difference Δt and a tilt angle (an angle between the specific straight line and the equiphase plane) α of the equiphase plane are in the following relation (c is a light speed in vacuum).

$$\Delta t-d\times\sin\alpha/c$$

Accordingly, in a case where a time delay Si imparted to a radio frequency signal supplied to each antenna element Ai is controlled so as to increase the time delay difference Δt, it is possible to increase the tilt angle α. In an opposite case where the time delay Si imparted to the radio frequency signal supplied to each antenna element Ai is controlled so as to reduce the time delay difference Δt, it is possible to reduce the tilt angle α. Thus described is the principle of beam forming.

The following description will discuss, with reference to FIGS. 13 through 15, typical configurations of conventional phased array antennas. A phased array antenna 13 shown in FIG. 13 is a transmitting antenna. A phased array antenna 14 shown in FIG. 14 is a receiving antenna. A phased array antenna 15 shown in FIG. 15 is a transmitting and receiving antenna. Hereinafter, a time delay is simply referred to as a "delay."

The phased array antenna 13 shown in FIG. 13 (1) uses time delay elements TD11 through TD1*n* so as to impart delays δ1 through δn with an equal difference therebetween to a radio frequency signal $V_{RF}(t)$ externally supplied and (2) supplies delayed radio frequency signals $V_{RF}(t-\delta 1)$ through $V_{RF}(t-\delta n)$ thus obtained to antenna elements A1 through An. In a case where the delays δ1 through δn imparted to the radio frequency signal $V_{RF}(t)$ are set so that a time delay difference $\Delta t=\delta 2-\delta 1=\delta 3-\delta 2= \ldots =\delta n-\delta n-1$ coincides with $d\times\sin\alpha/c$, it is possible to transmit efficiently an electromagnetic wave having a tilt angle of α of an equiphase plane.

The phased array antenna 14 shown in FIG. 14 (1) uses time delay elements TD21 through TD2*n* so as to impart delays δ1 through δn with an equal difference therebetween to respective radio frequency signals $V_{RF}(t+\delta 1)$ through $V_{RF}(t+\delta n)$ outputted from antenna elements A1 through An and (2) outputs, outside the phased array antenna 14, a delayed radio frequency signal $V_{RF}(t)$ thus obtained. In a case where the delays δ1 through δn imparted to the radio frequency signals $V_{RF}(t+\delta 1)$ through $V_{RF}(t+Sn)$ are set so that a time delay difference $\Delta t-\delta 2-\delta 1-\delta 3-\delta 2= \ldots =\delta n-\delta n-1$ coincides with $d\times\sin\alpha/c$, it is possible to receive efficiently an electromagnetic wave having a tilt angle of α of an equiphase plane.

The phased array antenna 15 shown in FIG. 15 is obtained by combining the phased array antenna 13 shown in FIG. 13 and the phased array antenna 14 shown in FIG. 14 with use of circulators (diplexers or switches) C1 through Cn. Each antenna element Ai is for both transmission and reception. Each circulator Ci is an element which (i) has three or more ports to and from which a signal is supplied and outputted and (i) outputs a signal, which is supplied to a certain port, through a port subsequent to the certain port along a direction indicated by a curved arrow shown in FIG. 15. In the phased array antenna 15, each circulator Ci has a function of (i) supplying, to a corresponding antenna element Ai, a delayed radio frequency signal $V_{RF}(t-\delta i)$ outputted from a corresponding time delay element TD1*i* for transmission and (ii) supplying, to a corresponding time delay element TD2*i* for reception, a radio frequency signal $V_{RF}(t+\delta i)$ outputted from the antenna element Ai. In the case of the diplexers or switches, each diplexer or switch has a function identical to the above function.

However, the phased array antennas 13 through 15 shown in FIGS. 13 through 15 are not suitable for use in a millimeter wave band. This is because it is difficult to impart a highly accurate delay to a radio frequency signal in a millimeter wave band with use of electrical means such as a time delay element.

In regard to this, there is also known a phased array antenna which delays a radio frequency signal with use of optical means. This phased array antenna, however, requires use of an optical component which is more expensive than an electronic component, so that an increase in cost is inevitable. Especially in a case where the phased array antenna is assumed to be used in a millimeter wave band, it is necessary to use a highly expensive modulator, photoelectric conversion element, and the like, by which a significant increase in cost is expected.

In view of this, in order for a phased array antenna usable in a millimeter wave band to be provided without use of optical means, it is an option to employ, in place of a time delay device that delays a radio frequency signal, a time delay device that delays an intermediate frequency signal or a local signal, each of which has a frequency lower than that of the radio frequency signal. Examples of such a time delay device are disclosed in Patent Literature 1 and Non-patent Literature 1.

CITATION LIST

Patent Literature

[Patent Literature 1]
Japanese Patent Application Publication Tokukai No. 2003-60424 (Publication date: Feb. 28, 2003)

Non-Patent Literature

[Non-Patent Literature 1]
Joshua D. Schwartz et al., "An Electronic UWB Continuously Tunable Time-Delay System With Nanosecond Delays", IEEE MICROWAVE AND WIRELESS COMPONENTS LETTERS, FEBRUARY 2008, VOL. 18, NO. 2, PP103-105

SUMMARY OF INVENTION

Technical Problem

According to each of time delay devices disclosed in Patent Literature 1 and Non-patent Literature 1, an amount of a delay imparted to a radio frequency signal can be controlled by being changed in accordance with a frequency of a local signal. However, as described below, according to each of the time delay devices disclosed in Patent Literature 1 and Non-patent Literature 1, a relationship between (i) an amount of change $\Delta f_{LO}$ in frequency $f_{LO}$, which is a control variable, of the local signal and (ii) an amount of change $\Delta\delta$ in delay $\delta$, which is a controlled variable, varies depending on a frequency $f_{RF}$ of the radio frequency signal. This makes it difficult to perform, over a wide band, accurate control of a time delay imparted to the radio frequency signal. Furthermore, phased array antennas in which the time delay devices disclosed in Patent Literature 1 and Non-patent Literature 1 are respectively used have a problem that it is difficult to perform, over a wide band, accurate control of a direction in which an electromagnetic wave can be efficiently transmitted or received.

(Problem of Patent Literature 1)

FIG. 16 is a block diagram showing a configuration of a time delay device 20 disclosed in Patent Literature 1. As shown in FIG. 16, the time delay device 20 includes two mixers MX1 and MX2 and a phase shifter PS.

The mixer MX1 is supplied with (i) a radio frequency signal $V_{RF}(t)$ outputted from a radio frequency signal source RF and (ii) a local signal $V_{LO}(t)$ outputted from a local signal source LO and then delayed by a transmission line extending from the local signal source LO to the mixer MX1. The radio frequency signal $V_{RF}(t)$ can be represented by, for example, the following formula (1), and the local signal $V_{LO}(t)$ can be represented by, for example, the following formula (2). Note that $\varphi_0$ is a line delay which is caused on the transmission line extending from the local signal source LO to the mixer MX1. Here, on the assumption that a line delay caused on a transmission line extending from the radio frequency signal source RF to the mixer MX1 is sufficiently small, a radio frequency signal outputted from the radio frequency signal source RF and a radio frequency signal supplied to the mixer MX1 are considered identical to each other.

[Math 1]

$$V_{RF}(t)=V_{RF}\cos(2\pi f_{RF}t) \tag{1}$$

[Math 2]

$$V_{LO}(t)=V_{LO}\cos(2\pi f_{LO}(t+\varphi_0)) \tag{2}$$

The mixer MX1 generates an intermediate frequency signal $V_{IF}(t)$ by (i) multiplying the radio frequency signal $V_{RF}(t)$ by the local signal $V_{LO}(t)$ and (ii) then removing a high frequency component (down-converting the radio frequency signal $V_{RF}(t)$ with use of the local signal $V_{LO}(t)$. In a case where the radio frequency signal $V_{RF}(t)$ and the local signal $V_{LO}(t)$ which are supplied to the mixer MX1 are respectively represented by the formulae (1) and (2), the intermediate frequency signal $V_{IF}(t)$ generated by the mixer MX 1 is represented by the following formula (3).

[Math 3]

$$V_{IF}(t)=\frac{V_{LO}V_{RF}}{2}\cos(2\pi(f_{RF}-f_{LO})t-2\pi f_{LO}\varphi_0) \tag{3}$$

The mixer MX2 is supplied with (i) the intermediate frequency signal $V_{IF}(t)$ outputted from the mixer MX1 and (ii) a local signal $V_{LO}'(t)$ which is obtained by delaying, by a transmission line extending from the local signal source LO to the mixer MX2 and by the phase shifter PS inserted on the transmission line, the local signal $V_{LO}(t)$ outputted from the local signal source LO. In a case where the local signal $V_{LO}(t)$ is represented by the above formula (2), the local signal $V_{LO}'(t)$ is represented by the following formula (4). Note that $\varphi_1$ is a sum of (i) a line delay caused on the transmission line extending from the local signal source LO to the mixer MX2 and (ii) a delay caused by the phase shifter PS inserted on the transmission line. Here, on the assumption that a line delay caused on a transmission line extending from the mixer MX1 to the mixer MX2 is sufficiently small, an intermediate frequency signal outputted from the mixer MX1 and an intermediate frequency signal supplied to the mixer MX2 are considered identical to each other.

[Math 4]

$$V_{LO}'(t)=V_{LO}\cos(2\pi f_{LO}(t-\varphi_1+\varphi_0)) \tag{4}$$

The mixer MX2 generates a delayed radio frequency signal $V_{RF}'(t)$ by (i) multiplying the intermediate frequency signal $V_{IF}(t)$ by the delay local signal $V_{LO}'(t)$ and (ii) then removing a low frequency component (up-converting the intermediate frequency signal $V_{IF}(t)$ with use of the delay local signal $V_{LO}'(t)$). In a case where the intermediate frequency signal $V_{IF}(t)$ and the delay local signal $V_{LO}'(t)$ which are supplied to the mixer MX2 are respectively represented by the formulae (3) and (4), the delayed radio frequency signal $V_{RF}'(t)$ generated by the mixer MX2 is represented by the following formula (5).

[Math 5]

$$V_{RF'}(t) = \frac{V_{LO}^2 V_{RF}}{4}\cos\left(2\pi f_{RF}\left(t - \frac{\varphi_1}{f_{RF}} f_{LO}\right)\right) \tag{5}$$

Accordingly, a delay δ of the delayed radio frequency signal $V_{RF}'(t)$ with respect to the radio frequency signal $V_{RF}(t)$ is represented by the following formula (6).

[Math 6]

$$\delta = \frac{\varphi_1}{f_{RF}} f_{LO} \tag{6}$$

As shown by the formula (6), the delay δ imparted by the time delay device 20 to the radio frequency signal $V_{RF}(t)$ is proportional to a frequency $f_{LO}$ of the local signal $V_{LO}(t)$. As such, by changing the delay δ imparted to the radio frequency signal $V_{RF}(t)$, it is possible to change the frequency $f_{LO}$ of the local signal $V_{LO}(t)$ in the time delay device 20.

However, as clear from the formula (6), an amount of change $\Delta f_{LO}$ in frequency $f_{LO}$, which is a control variable, of the local signal $V_{LO}(t)$ and an amount of change Δδ in delay δ, which is a controlled variable, are in a relation: $\Delta\delta=\{\varphi_1/f_{RF}\}\Delta f_{LO}$. Accordingly, an amount of change $\Delta f_{LO}$ in frequency $f_{LO}$ which amount is necessary in order to cause a change in delay δ by Δδ varies depending on a frequency $f_{RF}$ of the radio frequency signal $V_{RF}(t)$. For example, where an amount of change in frequency $f_{LO}$ which amount is necessary in order to increase a delay with respect to a 50 GHz radio frequency signal $V_{RF}(t)$ by 1 ps is 1 GHz, an amount of change in frequency $f_{LO}$ which amount is necessary in order to increase a delay with respect to a 100 GHz radio frequency signal $V_{RF}(t)$ by 1 ps is 2 GHz. Accordingly, it is difficult to perform, over a wide band, accurate control of the delay δ imparted to the radio frequency signal $V_{RF}(t)$.

(Problem Non-Patent Literature 1)

FIG. 17 is a block diagram showing a configuration of a time delay device 21 disclosed in Non-patent Literature 1. The time delay device 21 includes two mixers MX1 and MX2 and a dispersion imparting filter DF. The dispersion imparting filter DF is an element which imparts dispersion to an input signal, i.e., imparts a delay Df that is proportional to a frequency f of the input signal. The dispersion imparting filter DF is constituted by a chirped electromagnetic band-gap (CEBG) transmission line.

The mixer MX1 is supplied with (i) a radio frequency signal $V_{RF}(t)$ outputted from a radio frequency signal source RF and (ii) a local signal $V_{LO}'(t)$ obtained by delaying, by a transmission line TL1 extending from the local signal source LO to the mixer MX1, a local signal $V_{LO}(t)$ outputted from the local signal source LO. The radio frequency signal $V_{RF}(t)$ can be represented by, for example, the following formula (7). The local signal $V_{LO}(t)$ outputted from the local signal source LO can be represented by, for example, the following formula (8), and then the local signal $V_{LO}'(t)$ supplied to the mixer MX1 can be represented by the following formula (9). Note that ψ1 is a line delay caused on the transmission line TL1. Here, on the assumption that a line delay caused on a transmission line extending from the radio frequency signal source RF to the mixer MX1 is sufficiently small, a radio frequency signal outputted from the radio frequency signal source RF and a radio frequency signal supplied to the mixer MX1 are considered identical to each other.

[Math 7]

$$V_{RF}(t)=V_{RF}\cos(2\pi f_{RF}t) \tag{7}$$

[Math 8]

$$V_{LO}(t)=V_{LO}\cos(2\pi f_{LO}t) \tag{8}$$

[Math 9]

$$V_{LO}'(t)=V_{LO}\cos(2\pi f_{LO}t-\psi_1) \tag{9}$$

The mixer MX1 generates an intermediate frequency signal $V_{IF}(t)$ by down-converting the radio frequency signal $V_{RF}(t)$ with use of the local signal $V_{LO}'(t)$. In a case where the radio frequency signal $V_{RF}(t)$ and the local signal $V_{LO}'(t)$ which are supplied to the mixer MX1 are respectively represented by the formulae (7) and (9), the intermediate frequency signal $V_{IF}(t)$ generated by the mixer MX1 is represented by the following formula (10).

[Math 10]

$$V_{IF}(t) = \frac{v_{RF}v_{LO}}{2}\cos(2\pi(f_{RF} - f_{LO})t + 2\pi f_{LO}\psi_1) \tag{10}$$

The intermediate frequency signal $V_{IF}(t)$ generated by the mixer MX1 is delayed by a transmission line TL3 on which the dispersion imparting filter DF is inserted. The dispersion imparting filter DF imparts a delay τ=Df+ψ0 to a signal having a frequency f. The transmission line TL3 is constituted by a transmission line which extends from the mixer MX1 to a circulator C, a transmission line which extends from the circulator C to the dispersion imparting filter DF and then extends from the dispersion imparting filter DF to the circulator C, and a transmission line which extends from the circulator C to the mixer MX2. In a case where a line delay caused on the transmission line TL3 (excluding the dispersion imparting filter DF) is ψ3, an intermediate frequency signal $V_{IF}'(t)$ supplied to the mixer MX2 is represented by the following formula (11).

[Math 11]

$$V_{IF}'(t) = \frac{v_{RF}v_{LO}}{2}\cos(2\pi(f_{RF} - f_{LO})\{t + D(f_{RF} - f_{LO}) - \psi_0 - \psi_3\} + 2\pi f_{LO}\psi_1) \tag{11}$$

The mixer MX2 is supplied with not only the intermediate frequency signal $V_{IF}'(t)$ but also a local signal $V_{LO}''(t)$ which is obtained by delaying, by a transmission line TL2 extending from the local signal source LO to the mixer MX2, the local signal $V_{LO}(t)$ outputted from the local signal source LO. In a case where the local signal $V_{LO}(t)$ outputted from the local signal source LO is represented by the formula (8), the local signal $V_{LO}''(t)$ supplied to the mixer MX2 is represented by the following formula (12). Note that ψ2 is a line delay caused on the transmission line TL2.

[Math 12]

$$V_{LO}''(t)=V_{LO}\cos(2\pi f_{LO}(t-\psi_2)) \quad (12)$$

The mixer MX2 generates a delayed radio frequency signal $V_{RF}'(t)$ by up-converting the intermediate frequency signal $V_{IF}'(t)$ with use of the local signal $V_{LO}''(t)$. In a case where the intermediate frequency signal $V_{IF}'(t)$ and the local signal $V_{LO}''(t)$ which are supplied to the mixer MX2 are respectively represented by the formulae (11) and (12), the delayed radio frequency signal $V_{RF}'(t)$ generated by the mixer MX2 is represented by the following formula (13).

[Math 13]

$$V_{RF}'(t)=\frac{V_{RF}V_{LO}^2}{4}\cos\left(2\pi f_{RF}\left[t-\left\{\frac{-D}{f_{RF}}f_{LO}^2-\left(\frac{\psi_1+\psi_3-\psi_2}{f_{RF}}-2D\right)f_{LO}-Df_{RF}+\psi_0+\psi_3\right\}\right]\right) \quad (13)$$

Accordingly, a delay δ of the delayed radio frequency signal $V_{RF}'(t)$ with respect to the radio frequency signal $V_{RF}(t)$ is represented by the following formula (14).

[Math 14]

$$\delta=\frac{D}{f_{RF}}f_{LO}^2-\left(\frac{\psi_1+\psi_3-\psi_2}{f_{RF}}-2D\right)f_{LO}-Df_{RF}+\psi_0+\psi_3 \quad (14)$$

As shown by the formula (14), the delay δ imparted by the time delay device 21 to the radio frequency signal $V_{RF}(t)$ is a quadratic function of a frequency $f_{LO}$ of the local signal $V_{LO}(t)$. As such, by changing the delay δ imparted to the radio frequency signal $V_{RF}(t)$, it is possible to change the frequency $f_{LO}$ of the local signal $V_{LO}(t)$ in the time delay device 21.

However, as clear from the formula (14), an amount of change $\Delta f_{LO}$ in frequency $f_{LO}$, which is a control variable, of the local signal $V_{LO}(t)$ and an amount of change Δδ in delay δ, which is a controlled variable, are in a relation: $\Delta\delta=\{2Df_{LO}/f_{RF}-(\psi 1+\psi 3-\psi 2)/f_{RF}+2D\}\Delta f_{LO}$. Accordingly, an amount of change $\Delta f_{LO}$ in frequency $f_{LO}$ which amount is necessary in order to cause a change in delay δ by Δδ varies depending on a combination of a frequency $f_{RF}$ of the radio frequency signal $V_{RF}(t)$ and the frequency $f_{LO}$ of the local signal $V_{LO}(t)$. Accordingly, it is difficult to perform, over a wide band, accurate control of the delay δ imparted to the radio frequency signal $V_{RF}(t)$.

The present invention is accomplished in view of the foregoing problems. A main object of the present invention is to provide a time delay device which allows controlling, by causing a change in frequency of a local signal, a delay imparted to a radio frequency signal and further allows performing, over a wide band, the control of the delay imparted to the radio frequency signal more accurately as compared with a conventional technique.

Solution to Problem

In order to attain the object, a time delay device in accordance with one aspect of the present invention is a time delay device including: a first transmission line which generates a second local signal $V_{LO}'(t)=V_{LO}(t-\theta_1)$ by imparting a delay $\theta_1$ to a first local signal $V_{LO}(t)$ having a frequency $f_{LO}$; a first mixer which generates a first intermediate frequency signal $V_{IF}(t)$ having a frequency $f_{RF}-f_{LO}$, by multiplying a first radio frequency signal $V_{RF}(t)$ having a frequency $f_{RF}$ ($f_{LO}<f_{RF}$) by the second local signal $V_{LO}'(t)$; a second transmission line on which a first dispersion imparting filter is inserted, the second transmission line generating a third local signal $V_{LO}''(t)=V_{LO}(t-\theta_D-\theta_2)$ by imparting, to the first local signal $V_{LO}(t)$, a delay $\theta_D$ by the first dispersion imparting filter and a delay $\theta_2$ by the second transmission line; a third transmission line on which a second dispersion imparting filter is inserted, the second dispersion imparting filter imparting dispersion of opposite sign to dispersion imparted by the first dispersion imparting filter, the third transmission line generating a second intermediate frequency signal $V_{IF}'(t)=V_{IF}(t-\theta_D'-\theta_3)$ by imparting, to the first intermediate frequency signal $V_{IF}(t)$, a delay $\theta_D'$ by the second dispersion imparting filter and a delay $\theta_3$ by the third transmission line; and a second mixer which generates a second radio frequency signal $V_{RF}'(t)$ having the frequency $f_{RF}$, by multiplying the third local signal $V_{LO}'(t)$ by the second intermediate frequency signal $V_{IF}'(t)$.

Advantageous Effects of Invention

According to the present invention, it is possible to provide a time delay device which allows controlling, by causing a change in frequency of a local signal, a delay imparted to a radio frequency signal and further allows performing the control more accurately over a wide band as compared with a conventional technique.

Furthermore, with use of the time delay device of the present invention, it is possible to provide a phased array antenna which allows control of a direction (a main beam direction of an electromagnetic wave radiated) in which an electromagnetic wave can be efficiently transmitted or received to be performed more accurately over a wide band as compared with a conventional technique.

DESCRIPTION OF EMBODIMENTS

Embodiment 1

(Configuration of Time Delay Device)

Figure 1:
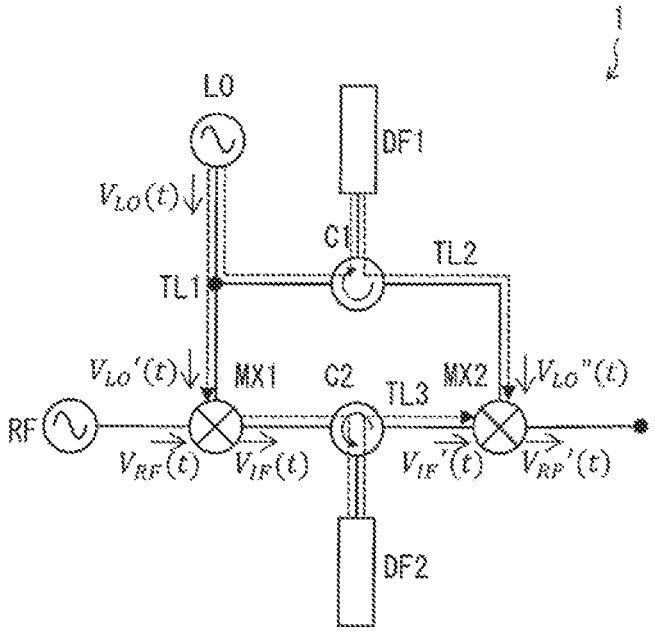
FIG. 1 is a block diagram showing a configuration of a time delay device in accordance with Embodiment 1 of the present invention.

The following description will discuss, with reference to FIG. 1, a time delay device 1 in accordance with Embodiment 1 of the present invention. FIG. 1 is a block diagram showing a configuration of the time delay device 1. The time delay device 1 can be provided in any of a transmitting phased array antenna, a receiving phased array antenna, and a transmitting and receiving phased array antenna. This point also applies to each of time delay devices in accordance with other embodiments, which will be described later.

Figure 15:
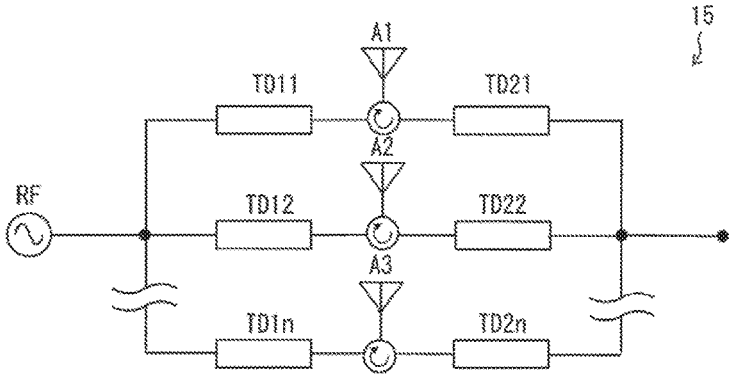
FIG. 15 is a block diagram showing an example configuration of a conventional transmitting and receiving phased array antenna.

As shown in FIG. 1, the time delay device 1 includes two mixers MX1 and MX2 (a first mixer and a second mixer, respectively), two circulators C1 and C2, and two dispersion imparting filters DF1 and DF2 (a first dispersion imparting filter and a second dispersion imparting filter, respectively). The circulators C1 and C2 function in a manner as described above with reference to FIG. 15.

The mixer MX1 has two input terminals, of which a first input terminal is connected to a radio frequency signal source RF which generates a first radio frequency signal $V_{RF}(t)$ having a frequency $f_{RF}$ ($f_{LO}<f_{RF}$). A second input terminal of the two input terminals of the mixer MX1 is connected to a first transmission line TL1. The first transmission line TL1 is a line that extends from an output terminal of a local signal source LO, which generates a first local signal $V_{LO}(t)$ having a frequency $f_{LO}$, to the second input terminal of the mixer MX1. The first transmission line TL1 generates a second local signal $V_{LO}'(t)-V_{LO}(t-\theta 1)$ by imparting a line delay $\theta_1$ to the first local signal $V_{LO}(t)$ generated by the local signal source LO.

The mixer MX2 has two input terminals, of which a first input terminal is connected to a second transmission line TL2 on which the dispersion imparting filter DF1 is inserted. The second transmission line TL2 is a line that extends so as to start from the output terminal of the local signal source LO, pass through a first port and a second port of the circulator C1, go to and return from the dispersion imparting filter DF1, pass through the second port and a third port of the circulator C1, and then reach the first input terminal of the mixer MX2. The second transmission line TL2 generates a third local signal $V_{LO}''(t)=V_{LO}(t-\theta_D-\theta_2)$ by imparting, to the first local signal $V_{LO}(t)$ generated by the local signal source LO, a line delay $\theta_2$ and a delay $\theta_D$ which is caused by the dispersion imparting filter DF1.

In a case where a dispersion imparting filter that imparts negative dispersion −D [s/Hz] is used as the dispersion imparting filter DF1, the delay $\theta_D$ imparted to the first local signal $V_{LO}(t)$ is $\theta_D=Df_{LO}+\theta_0$, and the third local signal $V_{LO}''(t)$ is $V_{LO}''(t)=V_{LO}(t-Df_{LO}-\theta_0-\theta_2)$. Meanwhile, in a case where a dispersion imparting filter that imparts positive dispersion +D [s/Hz] is used as the dispersion imparting filter DF1, the delay $\theta_D$ imparted to the first local signal $V_{LO}(t)$ is $\theta_D=-Df_{LO}+\theta_0$, and the third local signal $V_{LO}''(t)$ is $V_{LO}'(t)=V_{LO}(t+Df_{LO}-\theta_0-\theta_2)$.

Note that the dispersion imparting filter DF1 as described above can be realized by use of, for example, a chirped electromagnetic bandgap (CEBG) transmission line as disclosed in Non-patent Literature 1. The CEBG transmission line is constituted by a microstrip line having a strip conductor whose width is periodically increased and reduced. Accordingly, a position on the CEBG transmission line from which position an input signal is reflected can be changed so as to change a line length of the CEBG transmission line, in accordance with a frequency of the input signal. This allows imparting a delay to the input signal in accordance with a frequency of the input signal.

A second input terminal of the mixer MX2 is connected to a third transmission line TL3 on which the dispersion imparting filter DF2 is inserted. The third transmission line TL3 is a line that extends so as to start from an output terminal of the mixer MX1, pass through a first port and a second port of the circulator C2, go to and return from the dispersion imparting filter DF2, pass through the second port and a third port of the circulator C2, and then reach the second input terminal of the mixer MX2. The third transmission line TL3 generates a second intermediate frequency signal $V_{IF}'(t)=V_{IF}(t-\theta_D'-\theta_2)$ by imparting, to a first intermediate frequency signal $V_{IF}(t)$ generated by the mixer MX1, a line delay $\theta_3$ and a delay $\theta_D'$ which is caused by the dispersion imparting filter DF2.

As the dispersion imparting filter DF2, a dispersion imparting filter that imparts dispersion of equal absolute value and opposite sign to dispersion imparted by the dispersion imparting filter DF1. That is, in a case where a dispersion imparting filter that imparts negative dispersion −D [s/Hz] is used as the dispersion imparting filter DF1, a dispersion imparting filter that imparts positive dispersion +D [s/Hz] is used as the dispersion imparting filter DF2. Meanwhile, in a case where a dispersion imparting filter that imparts positive dispersion +D [s/Hz] is used as the dispersion imparting filter DF1, a dispersion imparting filter that imparts negative dispersion −D [s/Hz] is used as the dispersion imparting filter DF2.

In a case where the dispersion imparting filter DF2 has positive dispersion +D [s/Hz], the delay $\theta_D'$ imparted to the first intermediate frequency signal $V_{IF}(t)$ is OD'=−D($f_{RF}$−$f_{LO}$)+$\theta_0$, and the second intermediate frequency signal $V_{IF}'(t)$ is $V_{IF}'(t)=V_{IF}(t+D(f_{RF}-f_{LO})-\theta_0-\theta_2)$. Meanwhile, in a case where the dispersion imparting filter DF2 has negative dispersion −D [s/Hz], the delay $\theta_D'$ imparted to the first intermediate frequency signal $V_{IF}(t)$ is $\theta_D'=+D(f_{RF}-f_{LO})+\theta_0$, and the second intermediate frequency signal $V_{IF}'(t)$ is $V_{IF}'(t)=V_{IF}(t-D(f_{RF}-f_{LO})-\theta_0-\theta_2)$.

(Operation of Time Delay Device)

The following description will discuss an operation of the time delay device 1 having the configuration above in which operation the first radio frequency signal $V_{RF}(t)$ and the first local signal $V_{LO}(t)$ are supplied to the time delay device 1 and eventually the radio frequency signal $V_{RF}'(t)$ is outputted from the time delay device 1.

First, the first radio frequency signal $V_{RF}(t)$ generated by the radio frequency signal source RF and the first local signal $V_{LO}(t)$ generated by the local frequency signal source LO can be respectively represented by, for example, the following formulae (15) and (16).

[Math 15]

$$V_{RF}(t)=V_{RF}\cos(2\pi f_{RF}t) \tag{15}$$

[Math 16]

$$V_{LO}(t)=V_{LO}\cos(2\pi f_{LO}t) \tag{16}$$

The first input terminal of the mixer MX1 is supplied with the first radio frequency signal $V_{RF}(t)$ generated by the radio frequency signal source RF. The second input terminal of the mixer MX1 is supplied with the second local signal $V_{LO}'(t)$ which is obtained by delaying, by the first transmission line TL1 described above, the first local signal $V_{LO}(t)$ generated by the local signal source LO. In a case where the first local signal $V_{LO}(t)$ is represented by the formula (16), the second local signal $V_{LO}'(t)$ is represented by the following formula (17).

[Math 17]

$$V_{LO}'(t)=V_{LO}\cos(2\pi f_{LO}(t-\theta_1)) \tag{17}$$

The mixer MX1 generates the first intermediate frequency signal $V_{IF}(t)$ by multiplying the radio frequency signal $V_{RF}(t)$ by the second local signal $V_{LO}'(t)$ and then removing a high frequency component (down-converting the radio frequency signal $V_{RF}(t)$ with use of the second local signal $V_{LO}'(t)$). In a case where the radio frequency signal $V_{RF}(t)$ and the second local signal $V_{LO}'(t)$ which are supplied to the mixer MX1 are respectively represented by the formulae (15) and (17), the first intermediate frequency signal $V_{IF}(t)$ generated by the mixer MX1 is represented by the following formula (18).

[Math 18]

$$V_{IF}(t)=\frac{v_{RF}v_{LO}}{2}\cos(2\pi(f_{RF}-f_{LO})t+2\pi f_{LO}\theta_1) \tag{18}$$

The first input terminal of the mixer MX2 is supplied with the third local signal $V_{LO}''(t)$ which is obtained by delaying, by the second transmission line TL2, the first local signal $V_{LO}(t)$ generated by the local signal source LO. On the assumption that a dispersion imparting filter that imparts negative dispersion −D [s/Hz] is used as the dispersion imparting filter DF1 inserted in the second transmission line TL2, the third local signal $V_{LO}''(t)$ is represented by the following formula (19) in a case where the first local signal $V_{LO}(t)$ is represented by the formula (16).

[Math 19]

$$V_{LO}''(t)=V_{LO}\cos(2\pi f_{LO}(t-Df_{LO}-\theta_0-\theta_2)) \tag{19}$$

The second input terminal of the mixer MX2 is supplied with the second intermediate frequency signal $V_{IF}'(t)$ which is obtained by delaying, at the third transmission line TL3, the first intermediate frequency signal $V_{IF}(t)$ generated by the mixer MX1. On the assumption that a dispersion imparting filter that imparts positive dispersion +D [s/Hz] is used as the dispersion imparting filter DF2 inserted in the third transmission line TL3, the second intermediate frequency signal $V_{IF}'(t)$ is represented by the following formula (20) in a case where the first intermediate frequency signal $V_{IF}(t)$ is represented by the formula (18).

[Math 20]

$$V_{IF}'(t)=\frac{v_{RF}v_{LO}}{2}\cos(2\pi(f_{RF}-f_{LO})\{t+D(f_{RF}-f_{LO})-\theta_0-\theta_3\}+2\pi f_{LO}\theta_1) \tag{20}$$

The mixer MX2 generates the second radio frequency signal $V_{RF}'(t)$ by multiplying the second intermediate frequency signal $V_{IF}'(t)$ by the third local signal $V_{LO}''(t)$ and then removing a low frequency component (up-converting the second intermediate frequency signal $V_{IF}'(t)$ with use of the third local signal $V_{LO}'(t)$). In a case where the second intermediate frequency signal $V_{IF}'(t)$ and the third local signal $V_{LO}'(t)$ which are supplied to the mixer MX2 are respectively represented by the formulae (20) and (19), the second radio frequency signal $V_{RF}'(t)$ generated by the mixer MX2 is represented by the following formula (21).

[Math 21]

$$V_{RF}'(t)=\frac{V_{RF}V_{LO}^2}{4}\cos\left(2\pi f_{RF}\left[t-\left\{\left(\frac{\theta_2-(\theta_1+\theta_3)}{f_{RF}}+2D\right)f_{LO}-Df_{RF}+\theta_0+\theta_3\right\}\right]\right) \tag{21}$$

From the formula (21), a delay δ of the second radio frequency signal $V_{RF}'(t)$ with respect to the first radio frequency signal $V_{RF}(t)$ is represented by the following formula (22).

[Math 22]

$$\delta=\left(\frac{\theta_2-(\theta_1+\theta_3)}{f_{RF}}+2D\right)f_{LO}-Df_{RF}+\theta_0+\theta_3 \tag{22}$$

From the formula (22), the following matters are drawn. That is, according to the time delay device 1, it is possible to change the delay δ freely in accordance with the frequency $f_{LO}$ of the first local signal $V_{LO}(t)$. Furthermore, in the time delay device 1, an amount of change $\Delta f_{LO}$ in frequency $f_{LO}$, which is a control variable, of the local signal $V_{LO}(t)$ and an amount of change $\Delta\delta$ in delay $\delta$, which is a controlled variable, are in a relation: $\Delta\delta=\{(\theta_2-\theta_1-\theta_3)/f_{RF}-2D\}\Delta f_{LO}$ or a relation: $\Delta\delta=\{(\theta_2-\theta_1-\theta_3)/f_{RF}+2D\}\Delta f_{LO}$. Accordingly, as an electrical length of the second transmission line TL2 is approximated to a sum of an electrical length of the first transmission line TL1 and an electrical length of the third transmission line TL3 so that $\theta_2-\theta_1-\theta_3$ is approximated to 0, a degree of dependency of the amount of change $\Delta\delta$ in delay $\delta$ on the frequency $f_{RF}$ of the radio frequency signal $V_{RF}(t)$ can be reduced to whatever extent. In particular, in a case where the electrical length of the second transmission line TL2 is made to coincide with the sum of the electrical length of the first transmission line TL1 and the electrical length of the third transmission line TL3 so that $\theta_2-\theta_1-\theta_3=0$, the amount of change $\Delta\delta$ in delay $\delta$ does not depend on the frequency $f_{RF}$ of the radio frequency signal $V_{RF}(t)$. This facilitates, as compared with a conventional technique, the control of the delay $\delta$ in which control the frequency $f_{LO}$ of the local signal $V_{LO}(t)$ is a control variable.

The description above dealt with an operation in a case where the dispersion imparting filter that imparts negative dispersion −D [s/Hz] is used as the dispersion imparting filter DF1 and the dispersion imparting filter that imparts positive dispersion +D [s/Hz] is used as the dispersion imparting filter DF2. Note, however, that the present invention is not limited to this. That is, the dispersion imparting filter DF1 can be a dispersion imparting filter that imparts positive dispersion +D [s/Hz], and the dispersion imparting filter DF2 can be a dispersion imparting filter that imparts negative dispersion −D [s/Hz]. In this case, the delay $\delta$ is represented by the following formula (23), and an advantageous effect completely identical to the previously discussed advantageous effect is provided.

[Math 23]

$$\delta = \left(\frac{\theta_2 - (\theta_1 + \theta_3)}{f_{RF}} + 2D\right) f_{LO} + Df_{RF} + \theta_0 + \theta_3 \tag{23}$$

Embodiment 2

(Configuration of Time Delay Device)

Figure 2:
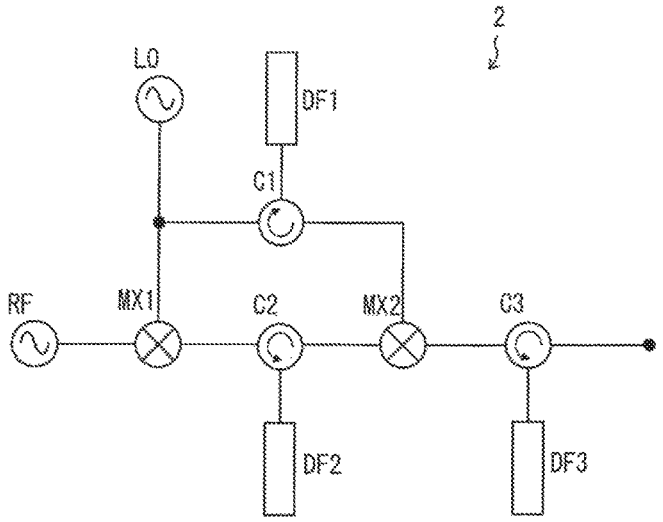
FIG. 2 is a block diagram showing a configuration of a time delay device in accordance with Embodiment 2 of the present invention.

The following description will discuss, with reference to FIG. 2, a configuration of a time delay device 2 in accordance with Embodiment 2 of the present invention. FIG. 2 is a block diagram showing a configuration of the time delay device 2. For easy explanation, the same reference signs will be given to configurations each having the same function as a configuration described in Embodiment 1, and descriptions on such a configuration will be omitted.

As shown in FIG. 2, the time delay device 2 further includes, in addition to the configuration of the time delay device 1, a circulator C3 and a dispersion imparting filter DF3 which are provided on an output side of a mixer MX2, that is, on a transmission line to which a second radio frequency signal $V_{RF}'(t)$ is outputted from the mixer MX2. The mixer MX2 has an output terminal which is connected to a first port among three ports of the circulator C3, and a second port of the circulator C3 is connected to the dispersion imparting filter DF3.

Dispersion imparted by the dispersion imparting filter DF3 is set to be of opposite sign to dispersion imparted by the dispersion imparting filter DF2. That is, in a case where the dispersion imparting filter DF2 imparts positive dispersion +D [s/Hz], the dispersion imparting filter DF3 imparts negative dispersion −D [s/Hz], and in a case where the dispersion imparting filter DF2 imparts negative dispersion −D [s/Hz], the dispersion imparting filter DF3 imparts positive dispersion +D [s/Hz].

Accordingly, a third radio frequency signal $V_{RF}''(t)$ which is obtained by correcting a delay included in the second radio frequency signal $V_{RF}'(t)$ and therefore has a more appropriate delay is outputted from a third port of the circulator C3.

(Operation of Time Delay Device)

A reason why the time delay device 2 is capable of generating the third radio frequency signal $V_{RF}''(t)$ having the more appropriate delay is as follows. The second radio frequency signal $V_{RF}'(t)$ has a frequency which is $f_{RF}$ based on the formula (21). Accordingly, in a case where the dispersion imparting filter DF2 imparts positive dispersion +D [s/Hz] and the dispersion imparting filter DF3 imparts negative dispersion −D [s/Hz], $V_{RF}''(t)=V_{RF}'(t-Df_{RF})$. It is thus possible to cancel a term $Df_{RF}$ included in the delay $\delta$ in the formula (22).

As such, when $\theta_2-(\theta_1+\theta_3)=0$, it is possible to generate a delay $\delta$ that does not contain the frequency $f_{RF}$ at all. In this case, the time delay device 2 is able to generate an optimum delay $\delta$ that fluctuates in proportion to a frequency $f_{LO}$ of a first local signal $V_{LO}(t)$.

Embodiment 3

(Configuration of Time Delay Device)

Figure 3:
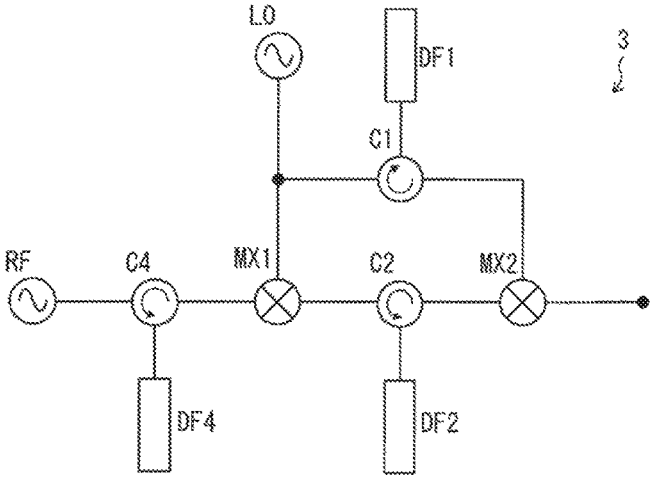
FIG. 3 is a block diagram showing a configuration of a time delay device in accordance with Embodiment 3 of the present invention.

The following description will discuss, with reference to FIG. 3, a configuration of a time delay device 3 in accordance with Embodiment 3 of the present invention. FIG. 3 is a block diagram showing a configuration of the time delay device 3. For easy explanation, the same reference signs will be given to configurations each having the same function as a configuration described in Embodiments 1 and 2, and descriptions on such a configuration will be omitted.

As shown in FIG. 3, the time delay device 3 further includes, in addition to the configuration of the time delay device 1, a circulator C4 and a dispersion imparting filter DF4 which are provided on an input side of a mixer MX1, that is, on a transmission line which supplies a first radio frequency signal $V_{RF}(t)$ to the mixer MX1. The circulator C4 has three ports, of which a first port is supplied with the first radio frequency signal $V_{RF}(t)$, a second port is connected to the dispersion imparting filter DF4, and a third port is connected to a first input terminal of the mixer MX1.

Dispersion imparted by the dispersion imparting filter DF4 is set to be of opposite sign to dispersion imparted by a dispersion imparting filter DF2. That is, in a case where the dispersion imparting filter DF2 imparts positive dispersion +D [s/Hz], the dispersion imparting filter DF4 imparts negative dispersion −D [s/Hz], and in a case where the dispersion imparting filter DF2 imparts negative dispersion −D [s/Hz], the dispersion imparting filter DF4 imparts positive dispersion +D [s/Hz].

Accordingly, a second radio frequency signal $V_{RF}'(t)$ having a more appropriate delay as compared with the time delay device 1 is outputted from an output terminal of a mixer MX2.

(Operation of Time Delay Device)

The following description will discuss an operation the time delay device 3 having the configuration above in which operation the first radio frequency signal $V_{RF}(t)$ and a first local signal $V_{LO}(t)$ are supplied to the time delay device 3 and eventually the second radio frequency signal $V_{RF}'(t)$ is outputted from the time delay device 3.

First, on the assumption that the dispersion imparting filter DF2 imparts positive dispersion +D [s/Hz] and the dispersion imparting filter DF4 imparts negative dispersion −D [s/Hz], the first radio frequency signal $V_{RF}(t)$ represented by the formula (15) is imparted a delay $Df_{RF}+\theta_0+\theta_5$ by being transmitted through the dispersion imparting filter DF4. Accordingly, the second radio frequency signal $V_{RF}'(t)$ supplied to a second input terminal of the mixer MX1 is represented by the following formula (24).

[Math 24]

$$V_{RF}'(t)=V_{RF}\cos(2\pi f_{RF}(t-Df_{RF}-\theta_0-\theta_5)) \tag{24}$$

The mixer MX1 generates a first intermediate frequency signal $V_{IF}(t)$ represented by the following formula (25), by down-converting the second radio frequency signal $V_{RF}'(t)$ with use of a second local signal $V_{LO}'(t)$ as represented by the formula (17).

[Math 25]

$$V_{IF}(t)=\frac{v_{RF}v_{LO}}{2}\cos(2\pi(f_{RF}-f_{LO})t-2\pi Df_{RF}^2+2\pi(f_{LO}\theta_1-f_{RF}\theta_0-f_{RF}\theta_5)) \tag{25}$$

The first intermediate frequency signal $V_{IF}(t)$ is imparted a delay as described above by a third transmission line TL3 and the dispersion imparting filter DF2 so as to become a second intermediate frequency signal $V_{IF}'(t)$ represented by the following formula (26), and then is supplied to a second input terminal of the mixer MX2.

[Math 26]

$$V_{IF}'(t)=\frac{v_{RF}v_{LO}}{2}\cos(2\pi(f_{RF}-f_{LO})\{t+D(f_{RF}-f_{LO})-\theta_0-\theta_3\}-2\pi Df_{RF}^2+2\pi(f_{LO}\theta_1-f_{RF}\theta_0-f_{RF}\theta_5)) \tag{26}$$

The mixer MX2 generates a second radio frequency signal $V_{RF}'(t)$ represented by the following formula (27), by up-converting the second intermediate frequency signal VIP'(t) with use of a third local signal $V_{LO}'(t)$ as represented by the formula (19).

[Math 27]

$$V_{RF}'(t)=\frac{v_{RF}v_{LO}^2}{4}\cos\left(2\pi f_{RF}\left\{t-\left(\frac{\theta_1+\theta_2-\theta_2}{f_{RF}}+2D\right)f_{LO}-2\theta_0-\theta_3-\theta_5\right\}\right) \tag{27}$$

It is known from the formula (27) that the $Df_{RF}$ term which is included in the delay δ, represented by the formula (22) or (23), in the time delay device 1 is absent in a delay included in the second radio frequency signal $V_{RF}'(t)$.

Thus, it is known from Embodiments 2 and 3 that a dispersion imparting filter which has a function of canceling the term $Df_{RF}$ from a delay δ can be inserted on a transmission line that supplies a first radio frequency signal $V_{RF}(t)$ to a mixer MX1 or can be inserted on a transmission line to which a second radio frequency signal $V_{RF}'(t)$ is outputted from a mixer MX2.

Embodiment 4

Figure 4:
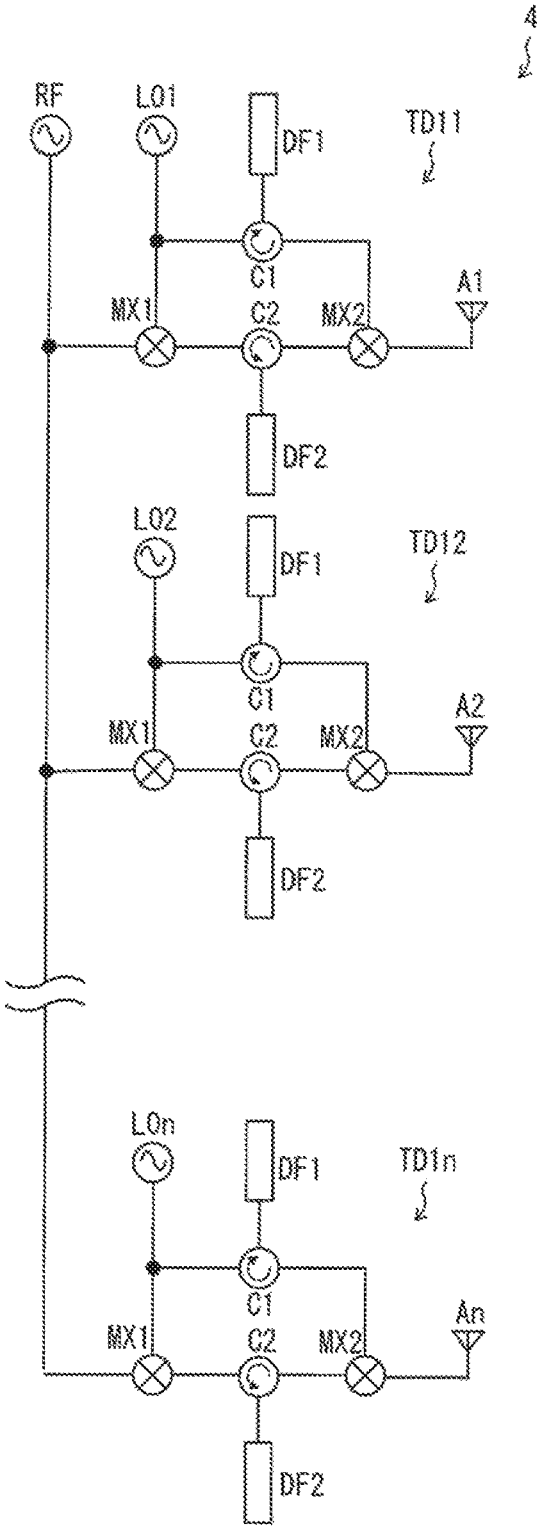
FIG. 4 is a block diagram concerning Embodiment 4 of the present invention and showing a configuration of a transmitting phased array antenna which includes the time delay device in accordance with Embodiment 1.

With reference to FIG. 4, the following description will discuss, as Embodiment 4, a transmitting phased array antenna 4 which includes the time delay device 1. FIG. 4 is a block diagram showing a configuration of the phased array antenna 4. For easy explanation, the same reference signs will be given to configurations each having the same function as a configuration described in Embodiments 1 through 3, and descriptions on such a configuration will be omitted.

The phased array antenna 4 is a transmitting antenna which includes n antenna elements A1, A2, . . . , An and n time delay devices TD11, TD12, . . . , TD1*n*, as shown in FIG. 4. To each time delay device TD1*i* (i=1 to n), a radio frequency signal $V_{RF}(t)$ (corresponding to the first radio frequency signal described above) outputted from a radio frequency signal source RF is supplied in common. A radio frequency signal $V_{RF}(t-\delta i)$ (corresponding to the second radio frequency signal described above) delayed by each time delay device TD1*i* is supplied to a corresponding antenna element Ai.

In the phased array antenna 4, a local signal $V_{LOi}(t)$ generated by each of local signal sources LO1, LO2, . . . , LOn has a frequency $f_{LOi}$ which is set in accordance with a position of a corresponding antenna element Ai in an order in which the antenna elements Ai are arranged, wherein the frequencies $f_{LOi}$ of the respective antenna elements Ai have an equal difference therebetween. Accordingly, delays δ1, δ2, . . . , δn which are imparted by the time delay devices TD11, TD12, . . . , TD1*n* to the first radio frequency signal $V_{RF}(t)$ are each set in accordance with a position of a corresponding antenna element Ai in an order in which the antenna elements Ai are arranged, wherein the delays δ1, δ2, . . . , δn have an equal difference therebetween. By setting a frequency difference $\Delta f_{LO}=f_{LO2}-f_{LO1}=f_{LO3}-f_{LO2}=\ldots=f_{LOn}-f_{LOn-1}$ so that a time delay difference $\Delta t=\delta 2-\delta 1=\delta 3-\delta 2=\ldots=\delta n-\delta n-1$ coincides with $d\times\sin\alpha/c$, it is possible to transmit efficiently an electromagnetic wave which has an equiphase plane with a tilt of α.

<<Comparison of Main Beam Direction According to the Present Invention and Main Beam Direction According to Conventional Technique>>

(Main Beam Direction According to the Present Invention)

First, on the basis of the formula (22), a delay δi of each time delay device TDi is represented by the following formula (28).

[Math 28]

$$\delta_i=\left(\frac{\theta_2-(\theta_1+\theta_3)}{f_{RF}}+2D\right)f_{LOi}-Df_{RF}+\theta_0+\theta_3 \tag{28}$$

Then, a time delay difference Δt=δi−δi−1 between each adjacent ones TD1*i* and TD1*i*−1 of the time delay devices is represented by the following formula (29).

[Math 29]

$$\Delta t=\delta_i-\delta_{i-1}=\left(\frac{\theta_2-(\theta_1+\theta_3)}{f_{RF}}+2D\right)(f_{LOi}-f_{LOi-1}) \tag{29}$$

In a case where frequencies of first local signals $V_{LO}(t)$ supplied to the respective adjacent time delay devices TD1*i* and TDi-1 are $f_{LOi}$ and $f_{LOi-1}$ and a frequency difference ($f_{LOi}-f_{LOi-1}$) in the formula (29) is $\Delta f_{LO}$, the time delay difference Δt is represented by the following formula (30).

[Math 30]

$$|\Delta t|=2D|\Delta f_{LO}| \quad (30)$$

It is known from the formula (30) that, according to the transmitting phased array antenna 4 which includes the time delay device 1 in accordance with one aspect of the present invention, no matter how a frequency $f_{RF}$ of the first radio frequency signal $V_{RF}(t)$ changes, the time delay difference Δt is uniquely defined on the basis of (i) dispersion D imparted by each of the dispersion imparting filters DF1 and DF2 and (ii) the frequency difference $\Delta f_{LO}$ between the first local signals $V_{LO}(t)$. This applies also to transmitting phased array antennas which respectively include the time delay device 2 and the time delay device 3.

The following description will discuss specific examples of how a main beam direction is set. For example, in a case where an electromagnetic wave in 60 GHz band (not less than 57 GHz and not more than 66 GHz) is radiated, a distance between each adjacent ones of the antenna elements can, for example, be set to ½ of a free space wavelength corresponding to a center frequency of 61.5 GHz, that is, be set to 2.44 mm. Further, an electrical length of a second transmission line TL2 is set equal to a sum of an electrical length of a first transmission line TL1 and an electrical length of a third transmission line TL3, so that $\theta_2-(\theta_1+\theta_3)=0$. A magnitude D of dispersion imparted by each of the dispersion imparting filters DF1 and DF2 is set to 5.7 ps/GHz, and the frequency difference $\Delta f_{LO}$ is set to 0.5 GHz. In this case, when these values are substituted into the dispersion D and the frequency difference $\Delta f_{LO}$, respectively, in the formula (30), the time delay difference Δt is 5.7 ps. On the basis of this value of the time delay difference Δt and d=2.44 mm, an angle α of a main beam direction determined from Δt=d sin α/c is approximately 45°.

Further, in a case where an electromagnetic wave in 70 GHz band (not less than 71 GHz and not more than 76 GHz) is radiated, a distance between each adjacent ones of the antenna elements can, for example, be set to ½ of a free space wavelength corresponding to a center frequency of 73.5 GHz, that is, be set to 2.04 mm. In this case, too, an angle α of a main beam direction is determined in exactly the same way as above, so that the angle α is approximately 45°.

(Main Beam Direction According to Conventional Technique)

Figure 16:
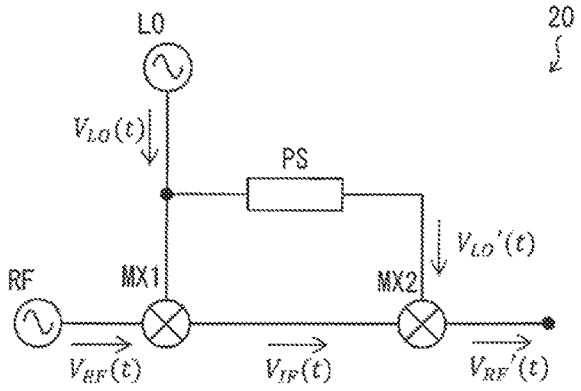
FIG. 16 is a block diagram showing an example configuration of a conventional time delay device.
Figure 17:
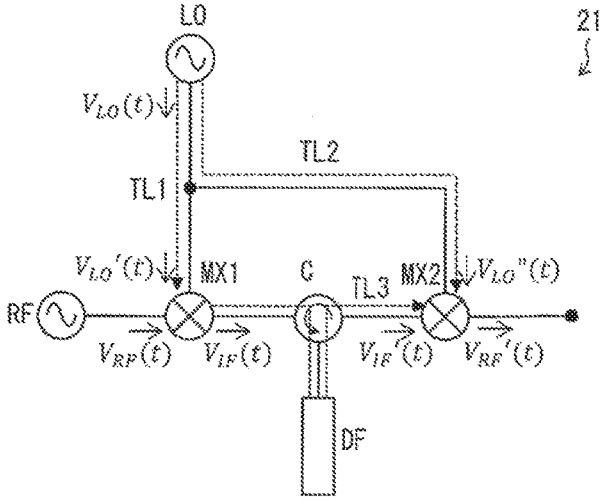
FIG. 17 is a block diagram showing another example configuration of a conventional time delay device.

It has been discussed above that a delay δ in the time delay device 20 which includes the configuration (FIG. 16) of Patent Literature 1 is obtained by the formula (6).

In a case where the frequency $f_{RF}$ is 57 GHz, a necessary frequency difference $\Delta f_{LO}$ between first local signals $V_{LO}(t)$ for each adjacent ones of the time delay devices is 3.2 GHz. Under this condition, a time delay difference Δt obtained on the basis of the formula (6) in a case where a delay $\theta_1$ imparted by the phase shifter PS is 100 ps and the frequency $f_{RF}$ is 66 GHz is approximately 4.9 ps. An angle α of a main beam direction corresponding to this time delay difference is approximately 37°.

Further, in a case where the frequency $f_{RF}$ is 71 GHz, a necessary frequency difference $\Delta f_{LO}$ between first local signals $V_{LO}(t)$ for each adjacent ones of the time delay devices is 3.4 GHz. Under this condition, a time delay difference Δt obtained on the basis of the formula (6) in a case where a delay $\theta_1$ imparted by the phase shifter PS is 100 ps and the frequency $f_{RF}$ is 76 GHz is approximately 4.5 ps. An angle α of a main beam direction corresponding to this time delay difference is approximately 41°.

As described above, according to the time delay device of Patent Literature 1, a change in frequency $f_{RF}$ undesirably causes a change in angle α of a main beam direction. It is therefore evident that the time delay device in accordance with the present invention is advantageous over the time delay device of Patent Literature 1.

Embodiment 5

Figure 5:
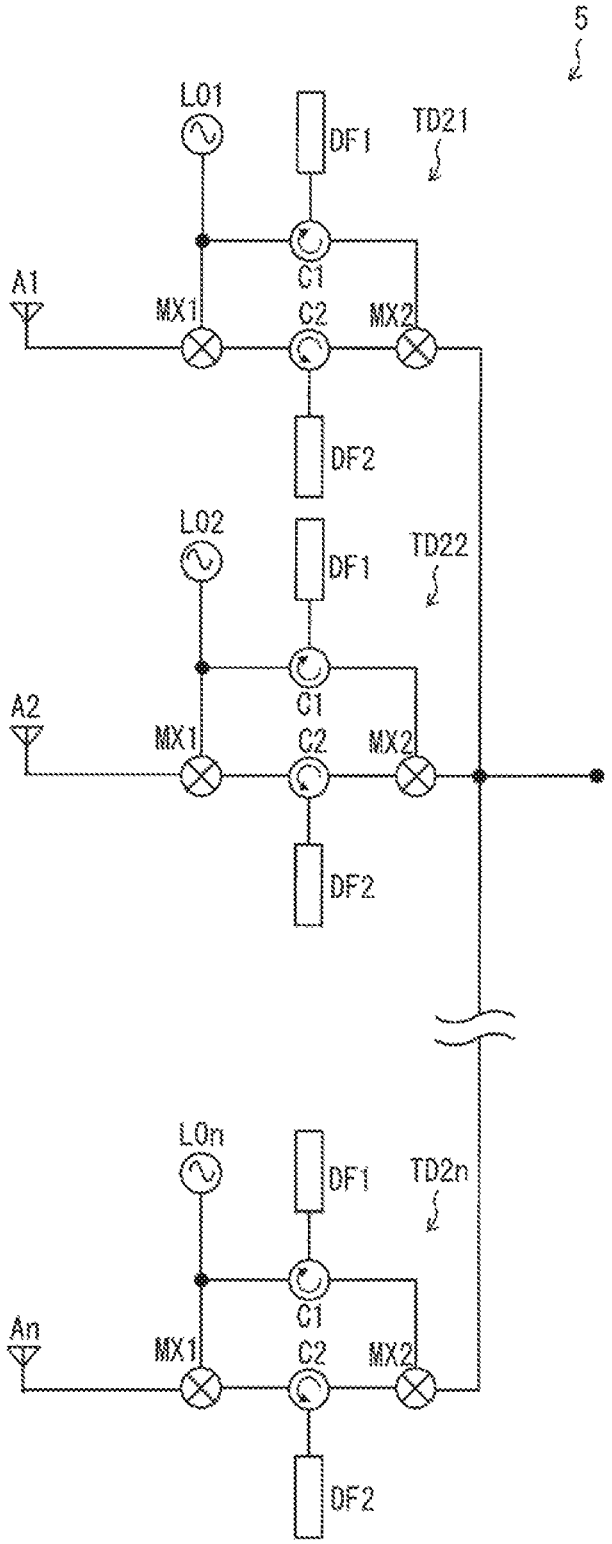
FIG. 5 is a block diagram concerning Embodiment 5 of the present invention and showing a configuration of a receiving phased array antenna which includes the time delay device in accordance with Embodiment 1.

With reference to FIG. 5, the following description will discuss, as Embodiment 5, a receiving phased array antenna 5 which includes the time delay device 1. FIG. 5 is a block diagram showing a configuration of the phased array antenna 5. For easy explanation, the same reference signs will be given to configurations each having the same function as a configuration described in Embodiments 1 through 4, and descriptions on such a configuration will be omitted.

The phased array antenna 5 is a receiving antenna which includes n antenna elements A1, A2, . . . , An and n time delay devices TD21, TD22, . . . , TD2*n*, as shown in FIG. 5. To each time delay device TD2*i* (i=1 to n), a radio frequency signal $V_{RF}(t+\delta i)$ (corresponding to the first radio frequency signal described above) outputted from a corresponding antenna element Ai is supplied individually. Radio frequency signals $V_{RF}(t)$ (each corresponding to the second radio frequency signal described above) delayed by the respective time delay devices TD2*i* are combined and then outputted outside the phased array antenna 5.

In the phased array antenna 5, a first local signal $V_{LO}(t)$ generated by each of local signal sources LO1, LO2, . . . , LOn has a frequency $f_{LO}$ which is set in accordance with a position of a corresponding antenna element Ai in an order in which the antenna elements Ai are arranged, wherein the frequencies $f_{LO}$ of the respective antenna elements Ai have an equal difference therebetween. Accordingly, delays δ1, δ2, . . . , δn which are imparted by the time delay devices TD21, TD22, . . . , TD2*n* to the radio frequency signal $V_{RF}(t)$ are each set in accordance with a position of a corresponding antenna element Ai in an order in which the antenna elements Ai are arranged, wherein the delays δ1, δ2, . . . , δn have an equal difference therebetween. By setting a frequency difference $\Delta f_{LO}=f_{LO2}-f_{LO1}=f_{LO3}-f_{LO2}=\ldots=f_{LOn}-f_{LOn-1}$ so that a time delay difference Δt=δ2−δ1=δ3−δ2=. . . =δn−δn−1 coincides with d×sin α/c, it is possible to receive efficiently an electromagnetic wave which has an equiphase plane with a tilt angle of α.

Embodiment 6

Figure 6:
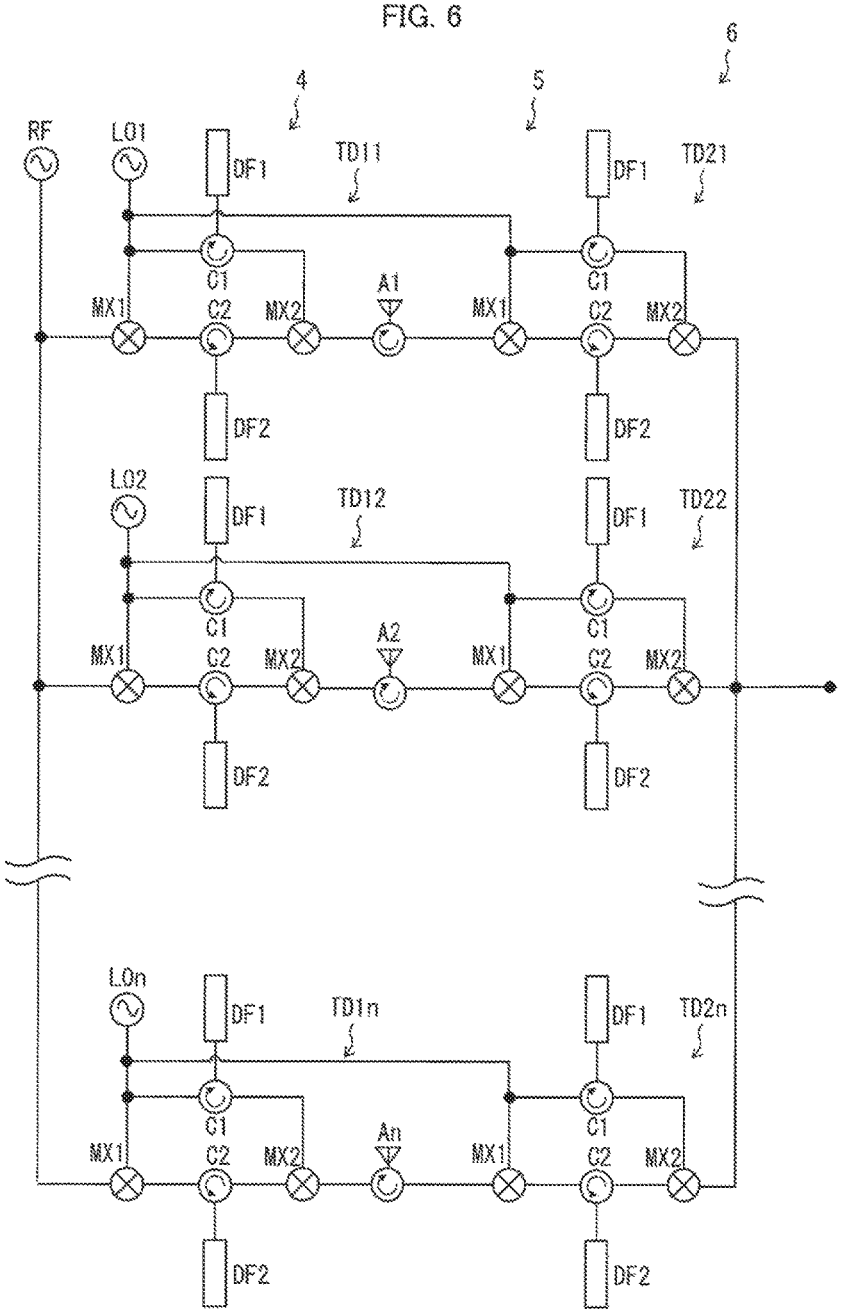
FIG. 6 is a block diagram concerning Embodiment 6 of the present invention and showing a configuration of a transmitting and receiving phased array antenna which is obtained by combining the transmitting phased array antenna shown in FIG. 4 and the receiving phased array antenna shown in FIG. 5.

With reference to FIG. 6, the following description will discuss, as Embodiment 6, a transmitting and receiving phased array antenna 6 which includes the time delay device 1. FIG. 6 is a block diagram showing a configuration of the phased array antenna 6. For easy explanation, the same reference signs will be given to configurations each having the same function as a configuration described in Embodiments 1 through 5, and descriptions on such a configuration will be omitted.

As shown in FIG. 6, the phased array antenna 6 is a transmitting and receiving phased array antenna which is obtained by combining the transmitting phased array antenna 4 shown in FIG. 4 and the receiving phased array antenna 5 shown in FIG. 5.

Note that the phased array antenna 6 has only one (1) set of local signal sources LO1 through LOn, which are shared by the phased array antenna 4 and the phased array antenna 5. More specifically, each local signal source LOi is connected to both of a corresponding time delay device TD1*i* in the phased array antenna 4 and a corresponding time delay device TD2*i* in the phased array antenna 5. Further, the phased array antenna 6 has only one (1) set of antenna elements A1 through An, which are shared by the phased array antenna 4 and the phased array antenna 5. More specifically, each antenna element Ai is connected to both of a corresponding time delay device TD1*i* in the phased array antenna 4 and a corresponding time delay device TD2*i* in the phased array antenna 5.

Embodiment 7

Figure 7:
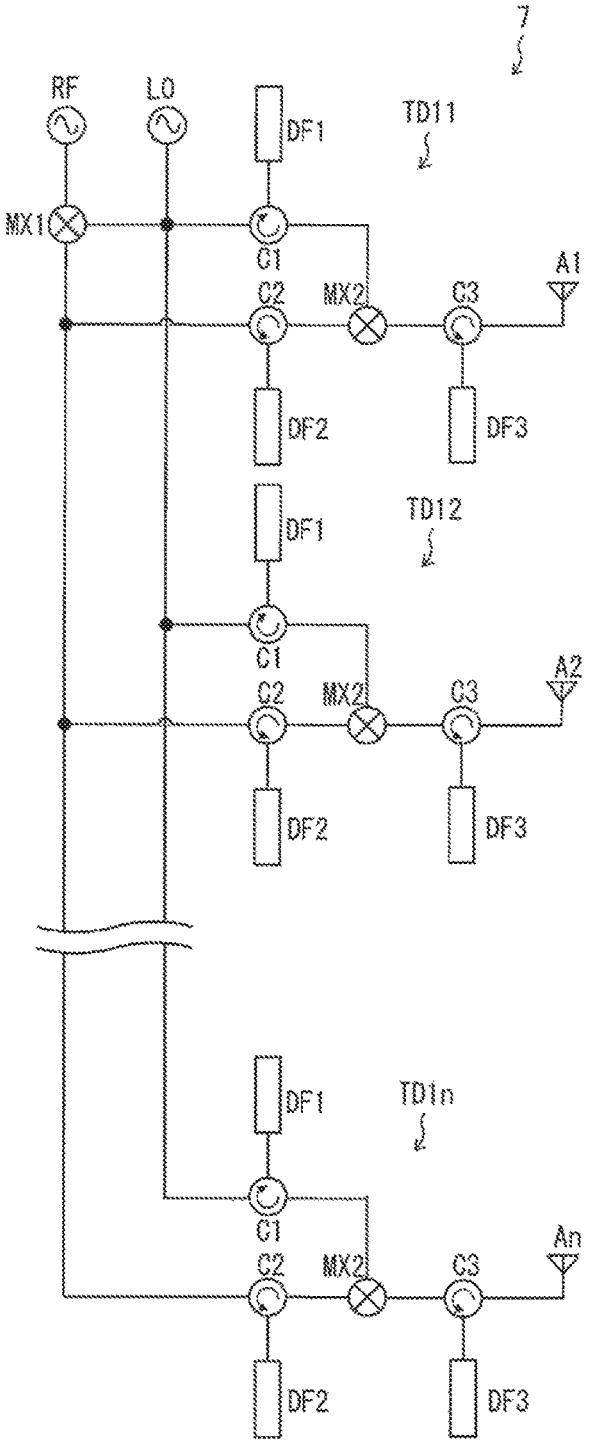
FIG. 7 is a block diagram concerning Embodiment 7 of the present invention and showing a configuration of a transmitting phased array antenna which includes a modified example of the time delay device in accordance with Embodiment 1.

With reference to FIG. 7, the following description will discuss, as Embodiment 7, another transmitting phased array antenna 7 which includes the time delay device 1. FIG. 7 is a block diagram showing a configuration of the phased array antenna 7. For easy explanation, the same reference signs will be given to configurations each having the same function as a configuration described in Embodiments 1 through 6, and descriptions on such a configuration will be omitted.

The phased array antenna 7 is a transmitting antenna which includes n antenna elements A1, A2, . . . , An and n time delay devices TD11, TD12, . . . , TD1*n*, as shown in FIG. 7. To each time delay device TD1*i* (i=1 to n), a radio frequency signal $V_{RF}(t)$ (corresponding to the first radio frequency signal described above) outputted from a radio frequency signal source RF is supplied in common. A radio frequency signal $V_{RF}(t-\delta i)$ delayed by each time delay device TD1*i* is supplied to a corresponding antenna element Ai.

A characteristic point of the phased array antenna 7 is that the phased array antenna 7 includes only one (1) local signal source LO and only one (1) mixer MX1, each of which is shared by the n time delay devices TD11, TD12, . . . , TD1*n*.

The shared mixer MX1 has (i) a first input terminal which is connected to an output terminal of the radio frequency signal source RF which is shared by the n time delay devices TD11, TD12, . . . , TD1*n*, and (ii) a second input terminal which is connected, via a first transmission line TL1 which is shared by the n time delay devices TD11, TD12, . . . , TD1*n*, to an output terminal of the shared local signal source LO. Accordingly, the shared mixer MX1 is supplied with (i) the radio frequency signal $V_{RF}(t)$ generated by the shared radio frequency signal source RF and (ii) a second local signal $V_{LO}'(t)$ obtained by delaying, by the shared first transmission line TL1, a first local signal $V_{LO}(t)$ generated by the shared local signal source LO. The shared mixer MX1 generates an intermediate frequency signal $V_{IF}(t)$ by down-converting the first radio frequency signal $V_{RF}(t)$ with use of the second local signal $V_{LO}'(t)$.

A mixer MX2 of each time delay device TD1*i* has (i) a first input terminal which is connected to the output terminal of the shared local signal source LO via a second transmission line TL2 (including a dispersion imparting filter DF1) of the each time delay device TD1*i* and (ii) a second input terminal which is connected to an output terminal of the shared mixer MX1 via a third transmission line TL3 (including a dispersion imparting filter DF2) of the each time delay device TD1*i*. Accordingly, the mixer MX2 of each time delay device TD1*i* is supplied with (i) a third local signal $V_{LO}'(t)$ obtained by delaying, by the second transmission line TL2 of the each time delay device TD1*i*, the first local signal $V_{LO}(t)$ generated by the shared local signal source LO and (ii) a second intermediate frequency signal $V_{IF}'(t)$ obtained by delaying, by the third transmission line TL3 of the each time delay device TD1*i*, the intermediate frequency signal $V_{IF}(t)$ generated by the shared mixer MX1. The mixer MX2 of each time delay device TD1*i* generates a second radio frequency signal $V_{RF}'(t)$ by up-converting the second intermediate frequency signal $V_{IF}'(t)$ with use of the third local signal $V_{LO}''(t)$. The second radio frequency signal $V_{RF}'(t)$ generated by the mixer MX2 of each time delay device TD1*i* is supplied to an antenna element Ai corresponding to the time delay device TD1*i*. Note that an electrical length of a second transmission line TL2 and an electrical length of a third transmission line TL3 are each equal between the time delay elements TD11 through TD1*n*.

Note that it is possible to employ a configuration in which, on a transmission line through which the second radio frequency signal $V_{RF}'(t)$ outputted from each mixer MX2 is transmitted to a corresponding antenna element Ai, a dispersion imparting filter DF3 (a third dispersion imparting filter) that imparts dispersion of opposite sign to dispersion imparted by the dispersion imparting filter DF2 is inserted. More specifically, a circulator C3 is inserted between each mixer MX2 and a corresponding antenna element Ai, and a first port, a second port, and a third port of the circulator C3 are respectively connected to an output terminal of the each mixer MX2, the dispersion imparting filter DF3, and the antenna element Ai.

This allows eliminating, from a delay Si of the second radio frequency signal $V_{RF}'(t)$ outputted from each time delay device TD1*i* with respect to the first radio frequency signal $V_{RF}(t)$, a term $+Df_{RF}$ or $-Df_{RF}$ which is in proportion to a frequency $f_{RF}$ of the first radio frequency signal $V_{RF}(t)$. As a result, it is possible to suppress disruption of a signal waveform of the second radio frequency signal $V_{RF}'(t)$ caused by the transmission line through which the second radio frequency signal $V_{RF}'(t)$ is transmitted to the antenna element Ai. This enables an improvement in signal quality of the second radio frequency signal $V_{RF}'(t)$.

In the phased array antenna 7, dispersion imparted by each of the dispersion imparting filters DF1 and DF2 of each of the time delay devices TD11, TD12, . . . , TD1*n* is set in accordance with a position of a corresponding antenna element Ai in an order in which the antenna elements Ai are arranged, wherein dispersion imparted in the respective time delay devices TD11, TD12, . . . , TD1*n* have an equal difference therebetween. That is, dispersion imparted by the respective dispersion imparting filters DF1 of the time delay devices TD11, TD12, . . . , TD1*n* are set to $-D$, $-(D+\Delta D)$, . . . , $-(D+(n-1)\Delta D)$, respectively, and dispersion imparted by the respective dispersion imparting filters DF2 of the time delay devices TD11, TD12, . . . , TD1*n* are set to D, $D+\Delta D$, . . . , $D+(n-1)\Delta D$, respectively. Accordingly, delays δ1, δ2, . . . , δn which are imparted by the time delay devices TD11, TD12, . . . , TD1*n* to the radio frequency signal $V_{RF}(t)$ are each set in accordance with a position of a corresponding antenna element Ai in an order in which the antenna elements Ai are arranged, wherein the delays δ1, δ2, . . . , δn have an equal difference therebetween. By setting a dispersion difference ΔD so that a time delay difference $\Delta t=\delta 2-\delta 1=\delta 3-\delta 2=\ldots=\delta n-\delta n-1$ coincides with $d\times\sin\alpha/c$, it is possible to transmit efficiently an electromagnetic wave which has an equiphase plane with a tilt angle of α.

In the phased array antenna 7, the time delay difference Δt is, as shown by the following formula (31), in proportion to a frequency $f_{LO}$ of the first local signal $V_{LO}(t)$, wherein a proportionality coefficient does not depend on the frequency $f_{RF}$ of the radio frequency signal $V_{RF}(t)$. As such, according to the phased array antenna 7, it is possible to perform, over a wide band, accurate control of a direction (a main beam direction of an electromagnetic wave radiated) in which an electromagnetic wave can be efficiently transmitted.

[Math 31]

$$\Delta t = 2d\ \Delta f_{LO} \tag{31}$$

Embodiment 8

Figure 8:
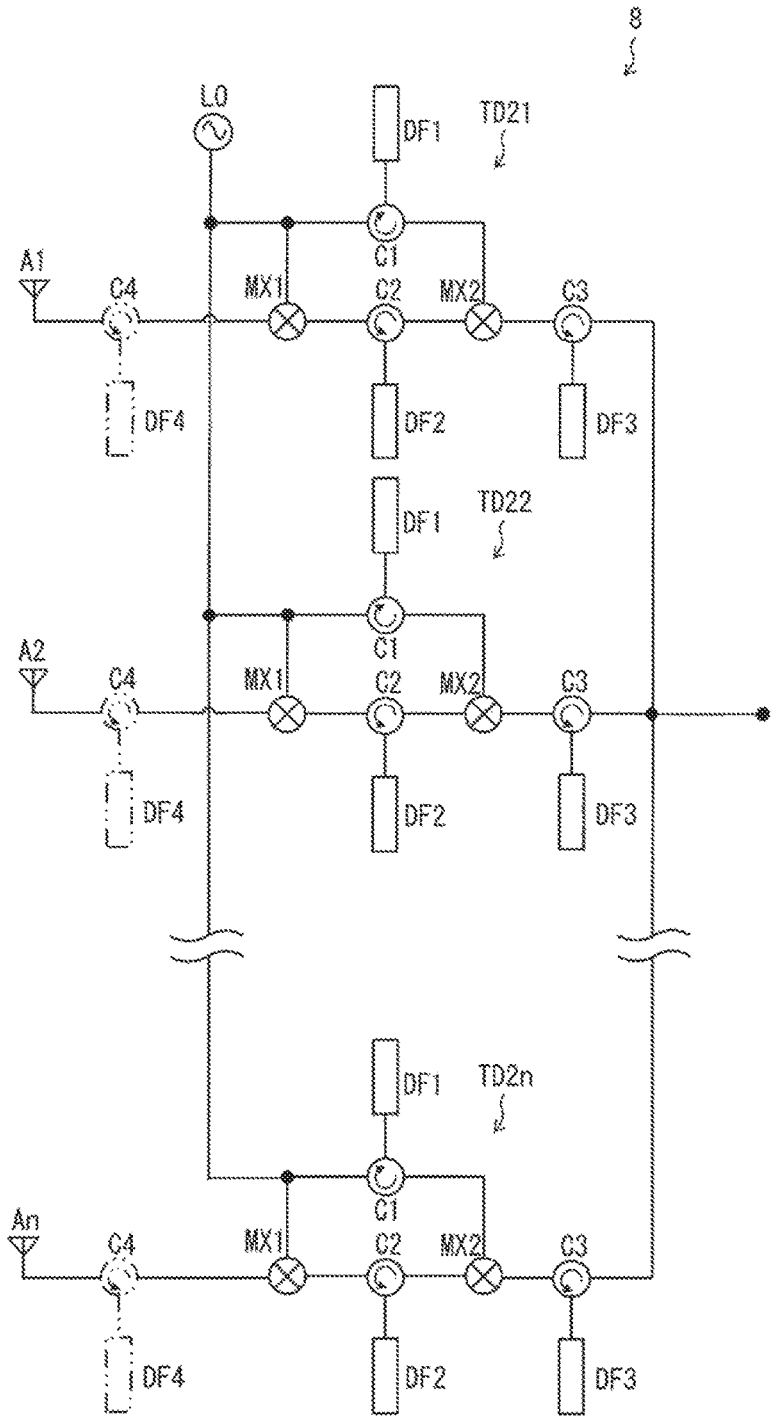
FIG. 8 is a block diagram concerning Embodiment 8 of the present invention and showing a configuration of a receiving phased array antenna which includes a modified example of the time delay device in accordance with Embodiment 1.

With reference to FIG. 8, the following description will discuss, as Embodiment 8, a receiving phased array antenna 8 which includes a modified example of the time delay device 1. FIG. 8 is a block diagram showing a configuration of the phased array antenna 8.

The phased array antenna 8 is a receiving antenna which includes n antenna elements A1, A2, . . . , An and n time delay devices TD21, TD22, . . . , TD2*n*, as shown in FIG. 8. To each time delay device TD2*i* (i=1 to n), a radio frequency signal $V_{RF}(t+\delta i)$ (corresponding to the first radio frequency signal described above) outputted from a corresponding antenna element Ai is supplied individually. Radio frequency signals $V_{RF}(t)$ (corresponding to the second radio frequency signal described above) delayed by the respective time delay devices TD2*i* are combined and then outputted outside the phased array antenna 8.

A characteristic point of the phased array antenna 8 is that the phased array antenna 8 includes only one (1) local signal source LO, which is shared by the n time delay devices TD21, TD22, . . . , TD2*n*.

A mixer MX1 of each time delay device TD2*i* has (i) a first input terminal which is connected to a corresponding antenna element Ai and (ii) a second input terminal which is connected, via a first transmission line TL1 of the each time delay device TD2*i*, to an output terminal of the shared local signal source LO. Accordingly, the mixer MX1 of each time delay device TD2*i* is supplied with (i) the radio frequency signal $V_{RF}(t)$ outputted from the corresponding antenna element Ai and (ii) a second local signal $V_{LO}'(t)$ obtained by delaying, by the first transmission line TL1 of the each time delay device TD2*i*, the first local signal $V_{LO}(t)$ generated by the shared local signal source LO. The shared mixer MX1 of each time delay device TD2*i* generates an intermediate frequency signal $V_{IF}(t)$ by down-converting the first radio frequency signal $V_{RF}(t)$ with use of the second local signal $V_{LO}'(t)$.

A mixer MX2 of each time delay device TD2*i* has (i) a first input terminal which is connected to the output terminal of the shared local signal source LO via a second transmission line TL2 (including a dispersion imparting filter DF1) of the each time delay device TD2*i* and (ii) a second input terminal which is connected to an output terminal of the mixer MX1 of the each time delay device TD2*i* via a third transmission line TL3 (including a dispersion imparting filter DF2) of the each time delay device TD2*i*. Accordingly, the mixer MX2 of each time delay device TD2*i* is supplied with (i) a third local signal $V_{LO}'(t)$ obtained by delaying, by the second transmission line TL2 of the each time delay device TD2*i*, the first local signal $V_{LO}(t)$ generated by the shared local signal source LO and (ii) a second intermediate frequency signal $V_{IF}'(t)$ obtained by delaying, by the third transmission line TL3 of each time delay device TD2*i*, the intermediate frequency signal $V_{IF}(t)$ generated by the mixer MX1 of each time delay device TD2*i*. The mixer MX2 of each time delay device TD2*i* generates a second radio frequency signal $V_{RF}'(t)$ by up-converting the second intermediate frequency signal $V_{IF}'(t)$ with use of the third local signal $V_{LO}''(t)$. The second radio frequency signals $V_{RF}'(t)$ generated by the respective mixers MX2 of the time delay devices TD2*i* are combined and then outputted outside the phased array antenna 8. Note that an electrical length of a first transmission line TL1, an electrical length of a second transmission line TL2, and an electrical length of a third transmission line TL3 are each equal between the time delay elements TD21 through TD2*n*.

Note that it is possible to employ a configuration in which, on a transmission line to which the second radio frequency signal $V_{RF}'(t)$ is outputted from each mixer MX2, a dispersion imparting filter DF3 (a third dispersion imparting filter) that imparts dispersion of opposite sign to dispersion imparted by the dispersion imparting filter DF2 is inserted. More specifically, a circulator C3 is inserted between each mixer MX2 and a combining terminal which outputs a sum signal between the second radio frequency signals $V_{RF}'(t)$ outputted by the respective time delay devices TD2*i*, and a first port, a second port, and a third port of the circulator C3 are respectively connected to an output terminal of the each mixer MX2, the dispersion imparting filter DF3, and the combining terminal.

This allows eliminating, from a delay Si of the second radio frequency signal $V_{RF}'(t)$ outputted from each time delay device TD2*i* with respect to the first radio frequency signal $V_{RF}(t)$, a term $+Df_{RF}$ or $-Df_{RF}$ which is in proportion to a frequency $f_{RF}$ of the first radio frequency signal $V_{RF}(t)$. As a result, it is possible to suppress disruption of a signal waveform of the second radio frequency signal $V_{RF}'(t)$ caused by the transmitted transmission line to which the second radio frequency signal $V_{RF}'(t)$ is outputted. This enables an improvement in signal quality of the second radio frequency signal $V_{RF}'(t)$.

Note that, instead of providing the dispersion imparting filter DF3 on the transmission line for the second radio frequency signal $V_{RF}'(t)$ outputted from each time delay device TD2*i*, it is possible to employ a configuration in which, on a transmission line from which the first radio frequency signal $V_{RF}(t)$ is supplied to each time delay device TD2*i*, a dispersion imparting filter DF4 that imparts dispersion of opposite sign to dispersion imparted by the dispersion imparting filter DF2 is inserted as the third dispersion imparting filter. More specifically, a circulator C4 is inserted between each antenna element Ai and a corresponding time delay device TD2*i*, and a first port, a second port, and a third port of the circulator C4 are respectively connected to the each antenna element Ai, the dispersion imparting filter DF4, and the first input terminal of the mixer MX1 of the each time delay device TD2*i*. The addition of the dispersion imparting filter DF4 provides an effect identical to the previously discussed advantageous effect that is provided by the dispersion imparting filter DF3.

In the phased array antenna 8, dispersion imparted by each of the dispersion imparting filters DF1 and DF2 of each of the time delay devices TD21, TD22, . . . , TD2*n* is set in accordance with a position of a corresponding antenna element Ai in an order in which the antenna elements Ai are arranged, wherein dispersion imparted in the respective time delay devices TD21, TD22, . . . , TD2*n* have an equal difference therebetween. That is, dispersion imparted by the respective dispersion imparting filters DF1 of the time delay devices TD21, TD22, . . . , TD2*n* are set to $-D$, $-(D+\Delta D)$, . . . , $-(D+(n-1)\Delta D)$, respectively, and dispersion imparted by the respective dispersion imparting filters DF2 of the time delay devices TD21, TD22, . . . , TD2*n* are set to D, D+ΔD, . . . , D+(n−1)ΔD, respectively. Accordingly, delays δ1, δ2, . . . , δn which are imparted by the time delay devices TD21, TD22, . . . , TD2*n* to the radio frequency signal $V_{RF}(t)$ are each set in accordance with a position of a corresponding antenna element Ai in an order in which the antenna elements Ai are arranged, wherein the delays δ1, δ2, . . . , δn have an equal difference therebetween. By setting a dispersion difference ΔD so that a time delay difference Δt=δ2−δ1=δ3−δ2= . . . =δn−δn−1 coincides with d×sin α/c, it is possible to receive efficiently an electromagnetic wave which has an equiphase plane with a tilt angle of α.

Embodiment 9

Figure 9:
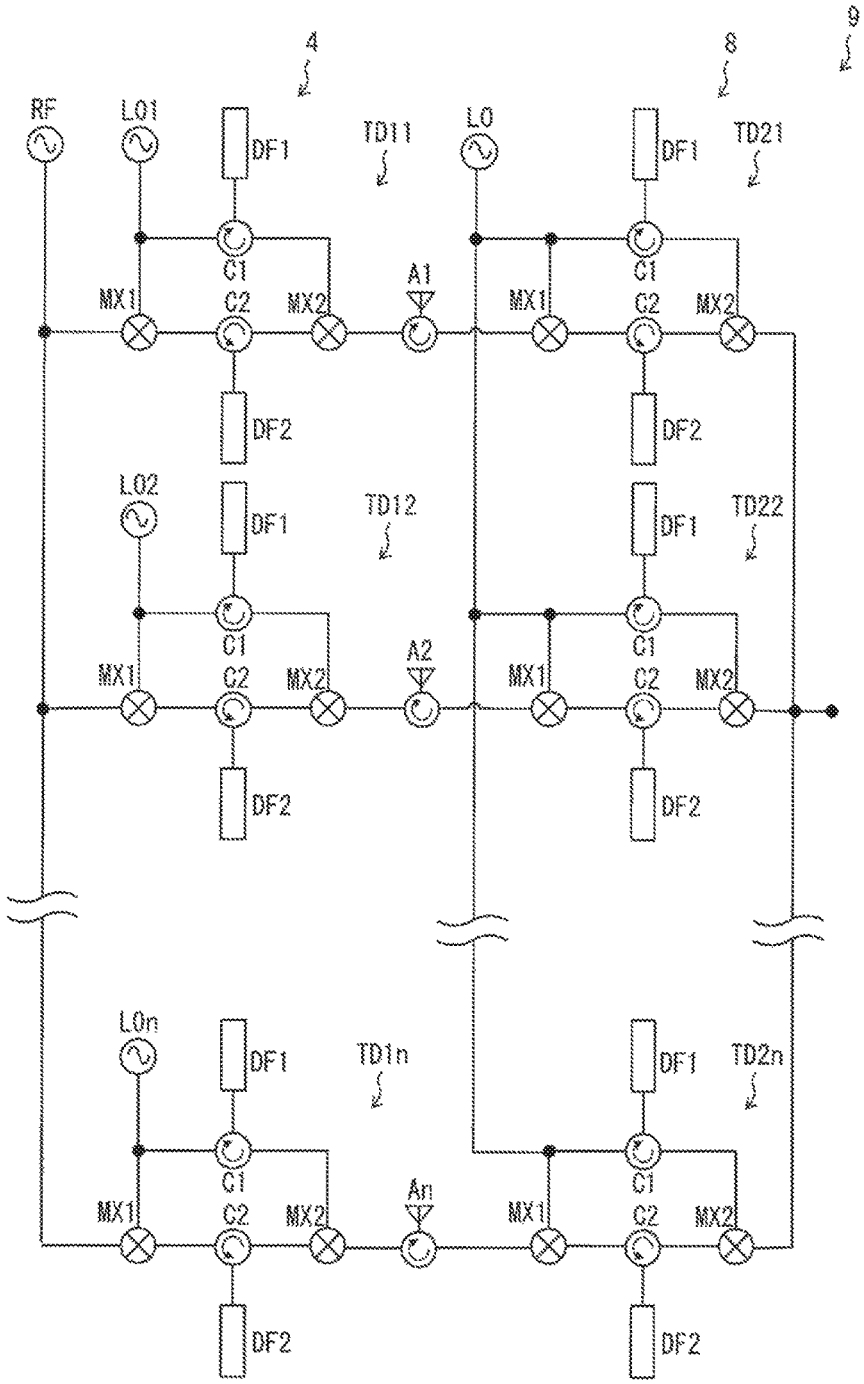
FIG. 9 is a block diagram concerning Embodiment 9 of the present invention and showing a configuration of a transmitting and receiving phased array antenna which is obtained by combining the transmitting phased array antenna shown in FIG. 4 and the receiving phased array antenna shown in FIG. 8.

As Embodiment 9, the following description will discuss a transmitting and receiving phased array antenna 9 with reference to FIG. 9. FIG. 9 is a block diagram showing a configuration of the phased array antenna 9.

As shown in FIG. 9, the phased array antenna 9 is a transmitting and receiving phased array antenna which is obtained by combining the transmitting phased array antenna 4 shown in FIG. 4 and the receiving phased array antenna 8 shown in FIG. 8.

The phased array antenna 9 thus configured also provides effects identical to the previously discussed effects provided by the transmitting and receiving phased array antenna 6.

Embodiment 10

Figure 10:
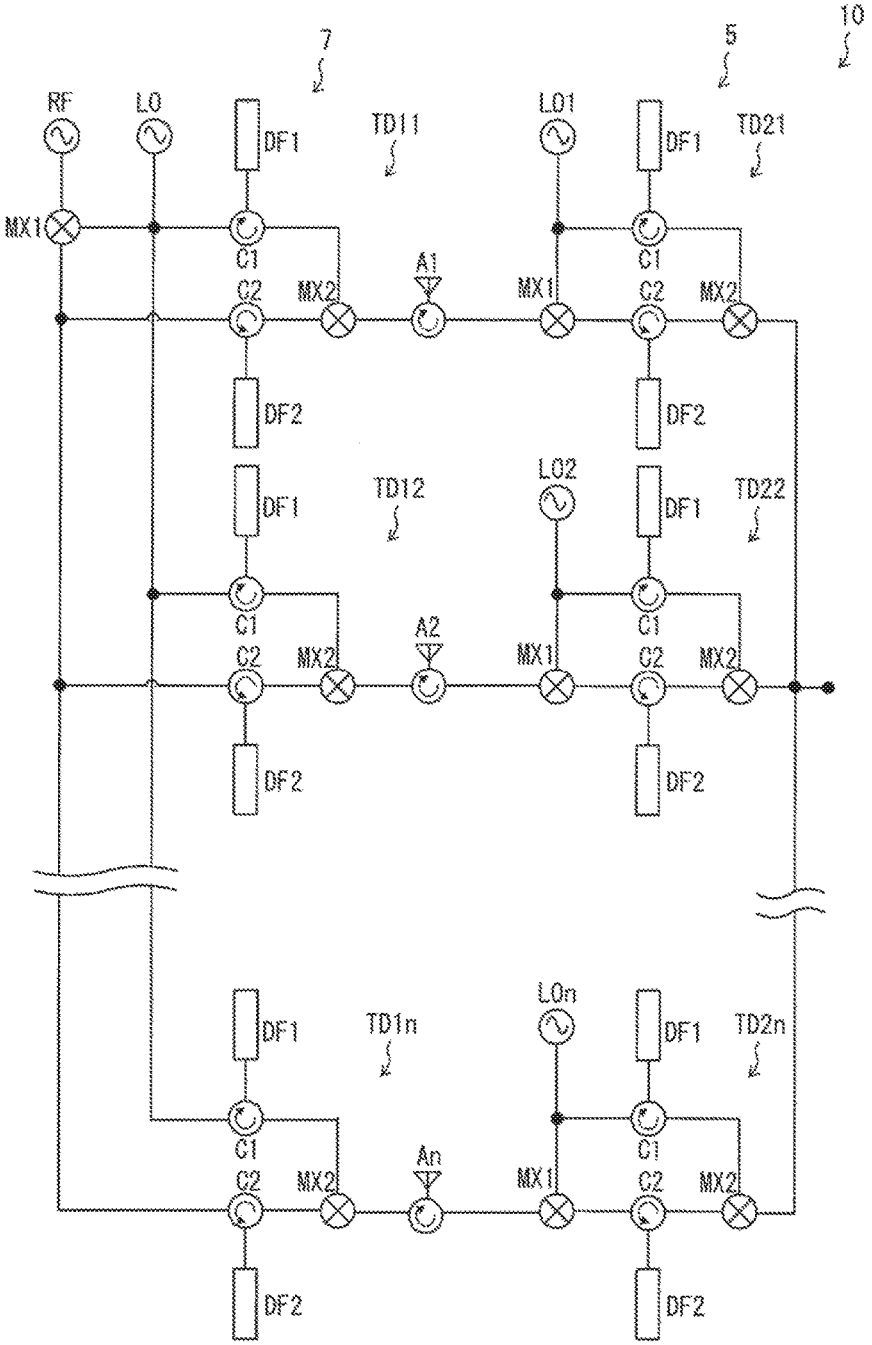
FIG. 10 is a block diagram concerning Embodiment 10 of the present invention and showing a configuration of a transmitting and receiving phased array antenna which is obtained by combining the transmitting phased array antenna shown in FIG. 7 and the receiving phased array antenna shown in FIG. 5.

As Embodiment 10, the following description will discuss a transmitting and receiving phased array antenna 10 with reference to FIG. 10. FIG. 10 is a block diagram showing a configuration of the phased array antenna 10.

As shown in FIG. 10, the phased array antenna 10 is a transmitting and receiving phased array antenna which is obtained by combining the transmitting phased array antenna 7 shown in FIG. 7 and the receiving phased array antenna 5 shown in FIG. 5.

The phased array antenna 10 thus configured also provides effects identical to the previously discussed effects provided by the transmitting and receiving phased array antenna 6.

Embodiment 11

Figure 11:
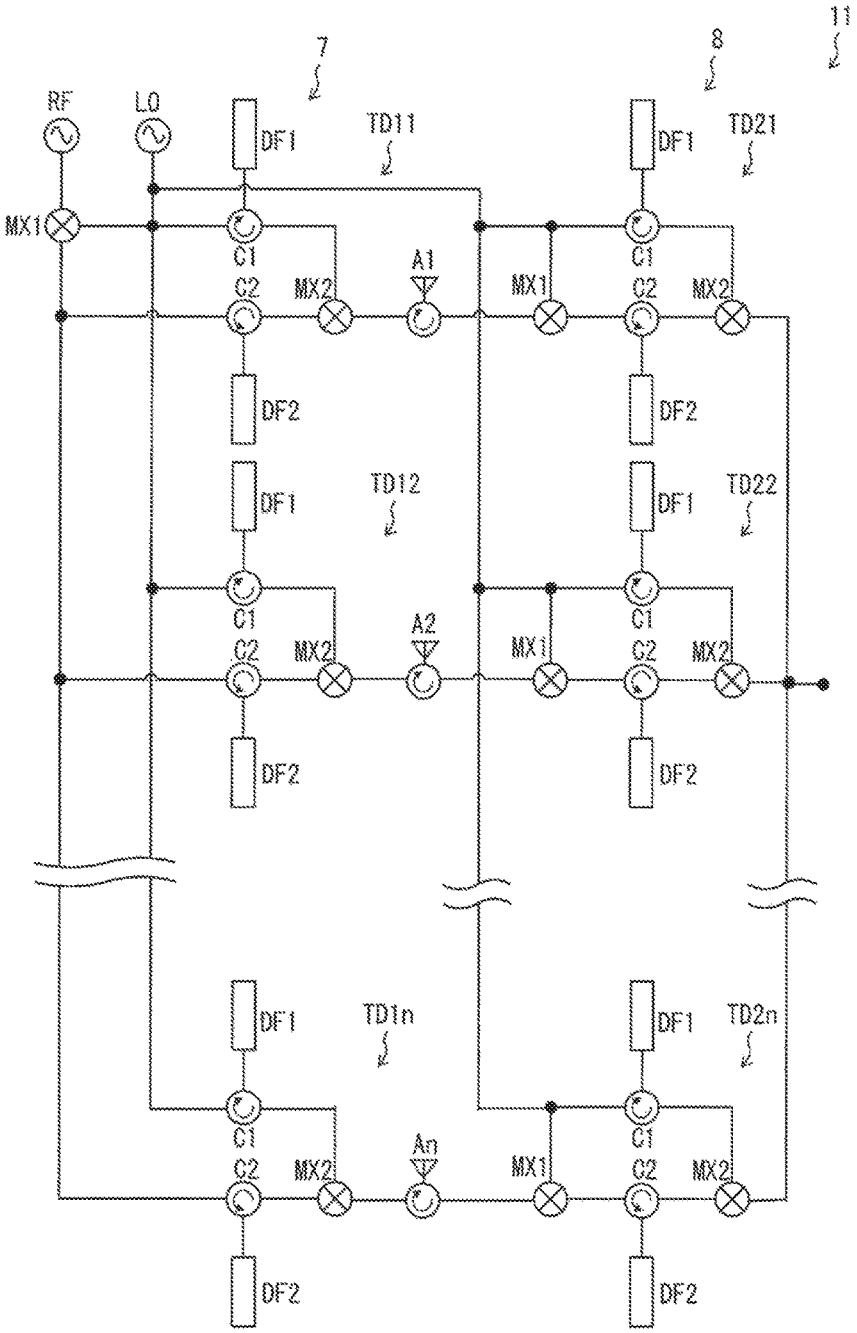
FIG. 11 is a block diagram concerning Embodiment 11 of the present invention and showing a configuration of a transmitting and receiving phased array antenna which is obtained by combining the transmitting phased array antenna shown in FIG. 7 and the receiving phased array antenna shown in FIG. 8.
Figure 12:
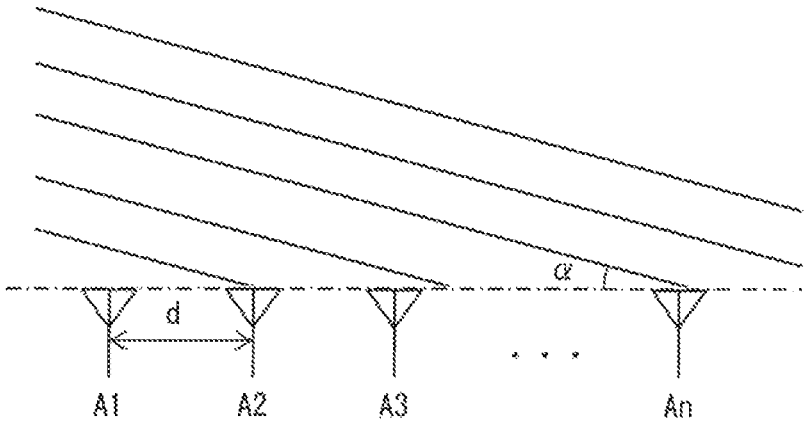
FIG. 12 is a view illustrating a principle of controlling a main beam direction of a radio wave transmitted and received by a phased array antenna.
Figure 13:
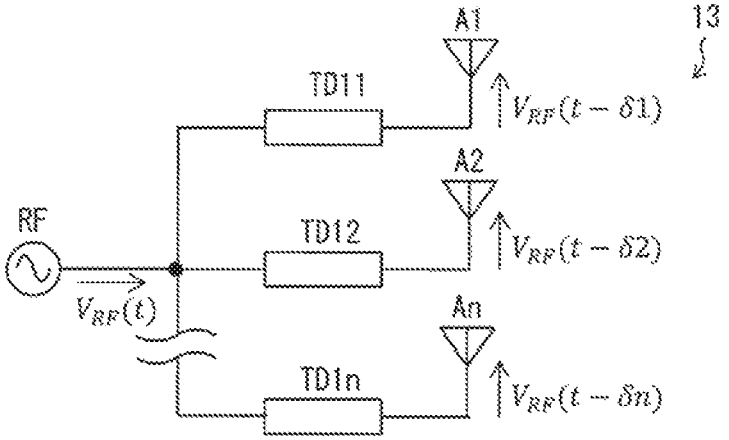
FIG. 13 is a block diagram showing an example configuration of a conventional transmitting phased array antenna.
Figure 14:
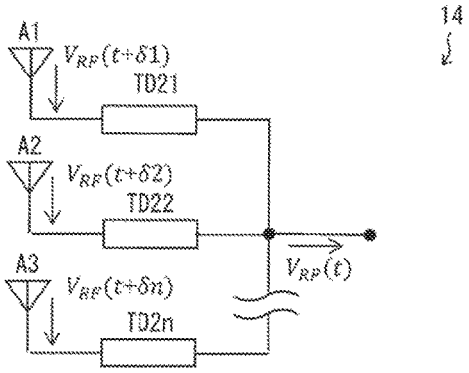
FIG. 14 is a block diagram showing an example configuration of a conventional receiving phased array antenna.

As Embodiment 11, the following description will discuss a transmitting and receiving phased array antenna 11 with reference to FIG. 11. FIG. 11 is a block diagram showing a configuration of the phased array antenna 11.

As shown in FIG. 11, the phased array antenna 11 is a transmitting and receiving phased array antenna which is obtained by combining the transmitting phased array antenna 7 shown in FIG. 7 and the receiving phased array antenna 8 shown in FIG. 8.

The phased array antenna 11 thus configured also provides effects identical to the previously discussed effects provided by the transmitting and receiving phased array antenna 6.

CONCLUSION

In order to attain the object, a time delay device in accordance with one aspect of the present invention is a time delay device including: a first transmission line which generates a second local signal $V_{LO}'(t)=V_{LO}(t-\theta_1)$ by imparting a delay $\theta_1$ to a first local signal $V_{LO}(t)$ having a frequency $f_{LO}$; a first mixer which generates a first intermediate frequency signal $V_{IF}(t)$ having a frequency $f_{RF}-f_{LO}$, by multiplying a first radio frequency signal $V_{RF}(t)$ having a frequency $f_{RF}$ ($f_{LO}<f_{RF}$) by the second local signal $V_{LO}'(t)$; a second transmission line on which a first dispersion imparting filter is inserted, the second transmission line generating a third local signal $V_{LO}''(t)=V_{LO}(t-\theta_D-\theta_2)$ by imparting, to the first local signal $V_{LO}(t)$, a delay $\theta_D$ by the first dispersion imparting filter and a delay $\theta_2$ by the second transmission line; a third transmission line on which a second dispersion imparting filter is inserted, the second dispersion imparting filter imparting dispersion of opposite sign to dispersion imparted by the first dispersion imparting filter, the third transmission line generating a second intermediate frequency signal $V_{IF}'(t)=V_{IF}(t-\theta_D'-\theta_3)$ by imparting, to the first intermediate frequency signal $V_{IF}(t)$, a delay $\theta_D'$ by the second dispersion imparting filter and a delay $\theta_3$ by the third transmission line; and a second mixer which generates a second radio frequency signal $V_{RF}'(t)$ having the frequency $f_{RF}$, by multiplying the third local signal $V_{LO}''(t)$ by the second intermediate frequency signal $V_{IF}'(t)$.

According to the arrangement above, in a case where the delay $\theta_D$ imparted by the first dispersion imparting filter is represented as $\theta_D'=+Df_{LO}+\theta_0$, and the delay $\theta_D'$ imparted by the second dispersion imparting filter is represented as $\theta_D'=-D(f_{RF}-f_{LO})+\theta_0$, a delay δ of the second radio frequency signal $V_{RF}'(t)$ with respect of the first radio frequency signal $V_{RF}(t)$ can be $\delta=\{(\theta_2-\theta_1-\theta_3)/f_{RF}+2D\}f_{LO}-Df_{RF}+\theta_0+\theta_3$ or $\delta=\{(\theta_2-\theta_1-\theta_3)/f_{RF}-2D\}f_{LO}+Df_{RF}+\theta_0+\theta_3$. Accordingly, it is possible to change the delay δ in accordance with the frequency $f_{LO}$ of the first local signal $V_{LO}(t)$.

Further, according to the arrangement above, an amount of change $\Delta f_{LO}$ in frequency $f_{LO}$, which is a control variable, of the local signal $V_{LO}(t)$ and an amount of change Δδ in delay δ, which is a controlled variable, are in a relation: $\Delta\delta=\{(\theta_2-\theta_1-\theta_3)/f_{RF}+2D\}\Delta f_{LO}$ or a relation: $\Delta\delta=\{(\theta_2-\theta_1-\theta_3)/f_{RF}-2D\}\Delta f_{LO}$. Accordingly, for example, as an electrical length of the second transmission line is approximated to a sum of an electrical length of the first transmission line and an electrical length of the third transmission line so that $\theta_2-\theta_1-\theta_3$ is approximated to 0, a degree of dependency of the amount of change Δδ in delay δ on the frequency $f_{RF}$ of the radio frequency signal $V_{RF}(t)$ can be reduced to whatever extent. This allows control of the delay δ imparted to the first radio frequency signal $V_{RF}(t)$ to be performed more accurately over a wide band, as compared with a conventional technique.

The time delay device in accordance with one aspect of the present invention is preferably configured such that the second transmission line has an electrical length equal to a sum of an electrical length of the first transmission line and an electrical length of the third transmission line.

According to the arrangement above, $\theta_2-\theta_1-\theta_3=0$. As such, the amount of change $\Delta f_{LO}$ in frequency $f_{LO}$, which is a control variable, of the local signal $V_{LO}(t)$ and the amount of change Δδ in delay δ, which is a controlled variable, are in a relation: $\Delta\delta=2D\Delta f_{LO}$ or a relation: $\Delta\delta=-2D\Delta f_{LO}$. Accordingly, the amount of change Δδ in delay δ does not depend on the frequency $f_{RF}$ of the radio frequency signal $V_{RF}(t)$. This allows control of the delay δ imparted to the first radio frequency signal $V_{RF}(t)$ to be performed even more accurately over a wide band.

The time delay device in accordance with one aspect of the present invention may be configured such that each of the first dispersion imparting filter and the second dispersion imparting filter is constituted by a CEBG (Chirped Electromagnetic Bandgap) transmission line.

The CEBG transmission line is a microstrip line which is capable of imparting dispersion to an input signal (imparting a delay that is in proportion to a frequency of the input signal). As such, according to the arrangement above, it is possible to provide each of the first dispersion imparting filter and the second dispersion imparting filter at low cost (at a cost similar to that of the microstrip line).

The time delay device in accordance with one aspect of the present invention is preferably configured such that a third dispersion imparting filter which imparts dispersion of opposite sign to the dispersion imparted by the second dispersion imparting filter is inserted on (i) a transmission line that transmits the first radio frequency signal $V_{RF}(t)$ supplied to the first mixer or (ii) a transmission line that transmits the second radio frequency signal $V_{RF}'(t)$ outputted from the second mixer.

According to the arrangement above, it is possible to eliminate, from the delay δ of the second radio frequency signal $V_{RF}'(t)$ with respect to the first radio frequency signal $V_{RF}(t)$, a term $+Df_{RF}$ or $-Df_{RF}$ which is in proportion to the frequency $f_{RF}$ of the radio frequency signal $V_{RF}(t)$.

A phased array antenna in accordance with a first aspect of the present invention is a phased array antenna including: n (n is an integer of 2 or more) antenna elements A1 through An; and n time delay devices TD11 through TD1*n*, each time delay device TD1*i* (i=1 to n) having any of the configurations of the time delay device above, the second radio frequency signal generated by the each time delay device TD1*i* being supplied to a corresponding antenna element Ai.

According to the arrangement above, it is possible to provide a transmitting phased array antenna which allows control of a direction (a main beam direction of an electromagnetic wave transmitted) in which an electromagnetic wave can be efficiently transmitted to be performed more accurately over a wide band as compared with a conventional technique.

The phased array antenna in accordance with one aspect of the present invention is preferably arranged such that the first local signal supplied to the each time delay device TD1*i* has a frequency which is set in accordance with a position of the corresponding antenna element Ai in an order in which the respective antenna elements Ai are provided, the frequencies of the respective time delay devices TD1*i* having an equal difference therebetween.

According to the arrangement above, in a case where the antenna elements A1 through An are arranged on the same straight line at equal intervals, control of a direction (a main beam direction of an electromagnetic wave transmitted) in which an electromagnetic wave can be efficiently transmitted can be performed accurately over a wide band.

A phased array antenna in accordance with a second aspect of the present invention is a phased array antenna including: n (n is an integer of 2 or more) antenna elements A1 through An; and n time delay devices TD21 through TD2*n*, each time delay device TD2*i* (i=1 to n) having any of the configurations of the time delay device above, a radio signal outputted from each antenna element Ai being supplied, as the first radio frequency signal, to a corresponding time delay device TD2*i*.

According to the arrangement above, it is possible to provide a receiving phased array antenna which allows control of a direction in which an electromagnetic wave can be efficiently received to be performed more accurately over a wide band as compared with a conventional technique.

The phased array antenna in accordance with the second aspect of the present invention is preferably configured such that the first local signal supplied to the each time delay device TD2*i* has a frequency which is set in accordance with a position of a corresponding antenna element Ai in an order in which the respective antenna elements Ai are provided, the frequencies of the respective time delay devices TD2*i* having an equal difference therebetween.

According to the arrangement above, in a case where the antenna elements A1 through An are arranged on the same straight line at equal intervals, it is possible to perform control of a direction in which an electromagnetic wave can be efficiently received, accurately over a wide band.

A phased array antenna in accordance with a third aspect of the present invention is a phased array antenna including: the phased array antenna in accordance with the first aspect, the phased array antenna serving as a transmitting antenna; and the phased array antenna in accordance with the second aspect, the phased array antenna serving as a receiving antenna, the antenna elements A1 through An being shared by the transmitting antenna and the receiving antenna.

According to the arrangement above, it is possible to provide a transmitting and receiving phased array antenna which allows control of a direction in which an electromagnetic wave can be efficiently transmitted and received to be performed more accurately over a wide band as compared with a conventional technique.

[Additional Matter]

The present invention is not limited to the above-described embodiments and modified examples but allows various modifications within the scope of the claims. Any embodiment derived from an appropriate combination of the technical means disclosed in the embodiments or the modified examples will also be included in the technical scope of the present invention.

REFERENCE SIGNS LIST

1, 2, 3 Time delay device
4, 5, 6, 7, 8, 9, 10, 11 Phased array antenna
A1, A2, . . . , An Antenna element
DF1 Dispersion imparting filter (first dispersion imparting filter)
DF2 Dispersion imparting filter (second dispersion imparting filter)
DF3, DF4 Dispersion imparting filter (third dispersion imparting filter)
TD11, TD12, . . . , TD1*n* Time delay device
TD21, TD22, . . . , TD2*n* Time delay device
MX1 Mixer (first mixer)
MX2 Mixer (second mixer)
TL1 First transmission line
TL2 Second transmission line
TL3 Third transmission line

The invention claimed is:

1. A time delay device, comprising:

a first transmission line which generates a second local signal $V_{LO}'(t)=V_{LO}(t-\theta_1)$ by imparting a delay $\theta_1$ to a first local signal $V_{LO}(t)$ having a frequency $f_{LO}$;

a first mixer which generates a first intermediate frequency signal $V_{IF}(t)$ having a frequency $f_{RF}-f_{LO}$, by multiplying a first radio frequency signal $V_{RF}(t)$ having a frequency $f_{RF}$ ($f_{LO}<f_{RF}$) by the second local signal $V_{LO}'(t)$;

a second transmission line on which a first dispersion imparting filter is inserted, the second transmission line generating a third local signal $V_{LO}''(t)=V_{LO}(t-\theta_D-\theta_2)$ by imparting, to the first local signal $V_{LO}(t)$, a delay $\theta_D$ by the first dispersion imparting filter and a delay $\theta_2$ by the second transmission line;

a third transmission line on which a second dispersion imparting filter is inserted, the second dispersion imparting filter imparting dispersion of opposite sign to dispersion imparted by the first dispersion imparting filter, the third transmission line generating a second intermediate frequency signal $V_{IF}'(t)=V_{IF}(t-\theta_D'-\theta_3)$ by imparting, to the first intermediate frequency signal $V_{IF}(t)$, a delay $\theta_D'$ by the second dispersion imparting filter and a delay $\theta_3$ by the third transmission line; and a second mixer which generates a second radio frequency signal $V_{RF}'(t)$ having the frequency $f_{RF}$, by multiplying the third local signal $V_{LO}''(t)$ by the second intermediate frequency signal $V_{IF}'(t)$.

2. The time delay device as set forth in claim 1, wherein the second transmission line has an electrical length equal to a sum of an electrical length of the first transmission line and an electrical length of the third transmission line.

3. The time delay device as set forth in claim 1, wherein each of the first dispersion imparting filter and the second dispersion imparting filter is constituted by a CEBG (Chirped Electromagnetic Bandgap) transmission line.

4. The time delay device as set forth in claim 1, wherein a third dispersion imparting filter which imparts dispersion of opposite sign to the dispersion imparted by the second dispersion imparting filter is inserted on (i) a transmission line that transmits the first radio frequency signal $V_{RF}(t)$ supplied to the first mixer or (ii) a transmission line that transmits the second radio frequency signal $V_{RF}'(t)$ outputted from the second mixer.

5. A phased array antenna comprising:

n (n is an integer of 2 or more) antenna elements A1 through An; and n time delay devices TD11 through TD1*n*, each time delay device TD1*i* (i=1 to n) having a configuration of a time delay device recited in claim 1, the second radio frequency signal generated by the each time delay device TD1*i* being supplied to a corresponding antenna element Ai.

6. The phased array antenna as set forth in claim 5, wherein the first local signal supplied to the each time delay device TD1*i* has a frequency which is set in accordance with a position of the corresponding antenna element Ai in an order in which the respective antenna elements Ai are provided, the frequencies of the respective time delay devices TD1*i* having an equal difference therebetween.

* * * * *